US008696369B2

(12) United States Patent
Mattson et al.

(10) Patent No.: US 8,696,369 B2
(45) Date of Patent: Apr. 15, 2014

(54) ELECTRICAL PLUG WITH MAIN CONTACTS AND RETRACTABLE SECONDARY CONTACTS

(75) Inventors: Loren Mattson, Richfield, MN (US); Christopher Charles Taylor, Cheltenham (GB); Gordon White, Gloucester (GB)

(73) Assignee: ADC Telecommunications, Inc., Berwyn, PA (US)

( * ) Notice: Subject to any disclaimer, the term of this patent is extended or adjusted under 35 U.S.C. 154(b) by 134 days.

(21) Appl. No.: 13/228,523

(22) Filed: Sep. 9, 2011

(65) Prior Publication Data

US 2012/0088412 A1 Apr. 12, 2012

Related U.S. Application Data

(60) Provisional application No. 61/381,241, filed on Sep. 9, 2010.

(51) Int. Cl.
*H01R 13/44* (2006.01)

(52) U.S. Cl.
USPC ..... 439/131; 439/620.23; 439/418

(58) Field of Classification Search
USPC ..... 439/131, 418, 620.17, 620.23
See application file for complete search history.

(56) References Cited

U.S. PATENT DOCUMENTS

| | | | |
|---|---|---|---|
| 3,243,761 | A | 3/1966 | Piorunneck |
| 4,127,317 | A | 11/1978 | Tyree |
| 4,684,245 | A | 8/1987 | Goldring |
| 4,953,194 | A | 8/1990 | Hansen et al. |
| 4,968,929 | A | 11/1990 | Hauck et al. |
| 4,978,310 | A | 12/1990 | Shichida |
| 5,052,940 | A | 10/1991 | Bengal |
| 5,107,532 | A | 4/1992 | Hansen et al. |
| 5,161,988 | A | 11/1992 | Krupka |
| 5,166,970 | A | 11/1992 | Ward |
| 5,222,164 | A | 6/1993 | Bass, Sr. et al. |
| 5,265,187 | A | 11/1993 | Morin et al. |
| 5,305,405 | A | 4/1994 | Emmons et al. |
| 5,353,367 | A | 10/1994 | Czosnowski et al. |
| 5,393,249 | A | 2/1995 | Morgenstern et al. |

(Continued)

FOREIGN PATENT DOCUMENTS

| | | |
|---|---|---|
| CA | 2499803 | 4/2004 |
| DE | 102 44 304 B3 | 3/2004 |

(Continued)

OTHER PUBLICATIONS

*Avaya's Enhanced SYSTIMAX® iPatch System Enables IT Managers to Optimise Network Efficiency and Cut Downtime*, Press Release, May 9, 2003, obtained from http://www.avaya.com/usa/about-avaya/newsroom/news-releases/2003/pr-030509 on Jan. 7, 2009.

(Continued)

*Primary Examiner* — James Harvey
(74) *Attorney, Agent, or Firm* — Merchant & Gould P.C.

(57) ABSTRACT

Aspects of the disclosure related to a plug module including main contacts that connect to conductors of an electrical cable and retractable secondary contacts that connect to a storage component installed on the plug module. The secondary contacts may be releasably latched in the retracted position. The secondary contacts may be biased to the extended position. The storage component may move along with the secondary contacts.

21 Claims, 44 Drawing Sheets

(56) References Cited

U.S. PATENT DOCUMENTS

| | | | | |
|---|---|---|---|---|
| 5,394,503 | A | 2/1995 | Dietz, Jr. et al. | |
| 5,413,494 | A | 5/1995 | Dewey et al. | |
| 5,418,334 | A | 5/1995 | Williams | |
| 5,419,717 | A | 5/1995 | Abendschein et al. | |
| 5,448,675 | A | 9/1995 | Leone et al. | |
| 5,467,062 | A | 11/1995 | Burroughs et al. | |
| 5,470,251 | A | 11/1995 | Sano | |
| 5,473,715 | A | 12/1995 | Schofield et al. | |
| 5,483,467 | A | 1/1996 | Krupka et al. | |
| 5,660,567 | A | 8/1997 | Nierlich et al. | |
| 5,674,085 | A | 10/1997 | Davis et al. | |
| 5,685,741 | A | 11/1997 | Dewey et al. | |
| 5,712,942 | A | 1/1998 | Jennings et al. | |
| 5,800,192 | A | 9/1998 | David et al. | |
| 5,821,510 | A | 10/1998 | Cohen et al. | |
| 5,854,824 | A | 12/1998 | Bengal et al. | |
| 5,871,368 | A | 2/1999 | Erdner et al. | |
| 6,002,331 | A | 12/1999 | Laor | |
| 6,059,583 | A * | 5/2000 | Croft et al. | 439/131 |
| 6,095,837 | A | 8/2000 | David et al. | |
| 6,095,851 | A | 8/2000 | Laity et al. | |
| 6,116,961 | A | 9/2000 | Henneberger et al. | |
| 6,222,908 | B1 | 4/2001 | Bartolutti et al. | |
| 6,222,975 | B1 | 4/2001 | Gilbert et al. | |
| 6,227,911 | B1 | 5/2001 | Boutros et al. | |
| 6,234,830 | B1 | 5/2001 | Ensz et al. | |
| 6,238,235 | B1 | 5/2001 | Shavit et al. | |
| 6,280,231 | B1 | 8/2001 | Nicholls | |
| 6,285,293 | B1 | 9/2001 | German et al. | |
| 6,300,877 | B1 | 10/2001 | Schannach et al. | |
| 6,330,148 | B1 | 12/2001 | Won et al. | |
| 6,330,307 | B1 | 12/2001 | Bloch et al. | |
| 6,350,148 | B1 | 2/2002 | Bartolutti et al. | |
| 6,364,694 | B1 | 4/2002 | Lien | |
| 6,421,322 | B1 | 7/2002 | Koziy et al. | |
| 6,422,895 | B1 | 7/2002 | Lien | |
| 6,424,710 | B1 | 7/2002 | Bartolutti et al. | |
| 6,456,768 | B1 | 9/2002 | Boncek et al. | |
| D466,479 | S | 12/2002 | Pein et al. | |
| 6,499,861 | B1 | 12/2002 | German et al. | |
| 6,511,231 | B2 | 1/2003 | Lampert et al. | |
| 6,522,737 | B1 | 2/2003 | Bartolutti et al. | |
| 6,554,484 | B2 | 4/2003 | Lampert et al. | |
| 6,574,586 | B1 | 6/2003 | David et al. | |
| 6,612,856 | B1 | 9/2003 | McCormack | |
| 6,626,697 | B1 | 9/2003 | Martin et al. | |
| 6,636,152 | B2 | 10/2003 | Schannach et al. | |
| 6,684,179 | B1 | 1/2004 | David | |
| 6,725,177 | B2 | 4/2004 | David et al. | |
| 6,743,044 | B2 | 6/2004 | Musolf et al. | |
| 6,793,408 | B2 | 9/2004 | Levy et al. | |
| 6,802,735 | B2 | 10/2004 | Pepe et al. | |
| 6,808,116 | B1 | 10/2004 | Eslambolchi et al. | |
| 6,811,446 | B1 | 11/2004 | Chang | |
| 6,814,624 | B2 | 11/2004 | Clark et al. | |
| 6,850,685 | B2 | 2/2005 | Tinucci et al. | |
| 6,898,368 | B2 | 5/2005 | Colombo et al. | |
| 6,905,363 | B2 | 6/2005 | Musolf et al. | |
| 6,932,517 | B2 | 8/2005 | Swayze et al. | |
| D510,068 | S | 9/2005 | Haggay et al. | |
| 6,939,168 | B2 | 9/2005 | Oleynick et al. | |
| 6,961,675 | B2 | 11/2005 | David | |
| 6,971,895 | B2 | 12/2005 | Sago et al. | |
| 6,976,867 | B2 | 12/2005 | Navarro et al. | |
| 7,077,710 | B2 | 7/2006 | Haggay et al. | |
| 7,081,808 | B2 | 7/2006 | Colombo et al. | |
| 7,112,090 | B2 | 9/2006 | Caveney et al. | |
| 7,123,810 | B2 | 10/2006 | Parrish | |
| 7,153,142 | B2 | 12/2006 | Shifris et al. | |
| 7,165,728 | B2 | 1/2007 | Durrant et al. | |
| 7,193,422 | B2 | 3/2007 | Velleca et al. | |
| 7,207,819 | B2 | 4/2007 | Chen | |
| 7,210,858 | B2 | 5/2007 | Sago et al | |
| 7,226,217 | B1 | 6/2007 | Benton et al. | |
| 7,234,944 | B2 | 6/2007 | Nordin et al. | |
| 7,241,157 | B2 | 7/2007 | Zhuang et al. | |
| 7,297,018 | B2 | 11/2007 | Caveney et al. | |
| 7,312,715 | B2 | 12/2007 | Shalts et al. | |
| D559,186 | S | 1/2008 | Kelmer | |
| 7,315,224 | B2 | 1/2008 | Gurovich et al. | |
| 7,352,289 | B1 | 4/2008 | Harris | |
| 7,370,106 | B2 | 5/2008 | Caveney | |
| 7,384,300 | B1 | 6/2008 | Salgado et al. | |
| 7,396,245 | B2 | 7/2008 | Huang et al. | |
| 7,479,032 | B2 | 1/2009 | Hoath et al. | |
| 7,481,681 | B2 | 1/2009 | Cafeney et al. | |
| 7,497,709 | B1 | 3/2009 | Zhang | |
| 7,519,000 | B2 | 4/2009 | Caveney et al. | |
| 7,534,137 | B2 | 5/2009 | Caveney et al. | |
| 7,552,872 | B2 | 6/2009 | Tokita et al. | |
| 7,559,805 | B1 | 7/2009 | Yi et al. | |
| 7,563,116 | B2 | 7/2009 | Wang | |
| 7,570,861 | B2 | 8/2009 | Smrha et al. | |
| 7,575,454 | B1 | 8/2009 | Aoki et al. | |
| 7,588,470 | B2 | 9/2009 | Li et al. | |
| 7,591,667 | B2 | 9/2009 | Gatnau Navarro et al. | |
| 7,607,926 | B2 | 10/2009 | Wang | |
| 7,635,280 | B1 | 12/2009 | Crumlin et al. | |
| 7,648,377 | B2 | 1/2010 | Naito et al. | |
| 7,682,174 | B2 | 3/2010 | Chen | |
| 7,722,370 | B2 | 5/2010 | Chin | |
| 7,727,026 | B2 | 6/2010 | Qin et al. | |
| 7,798,832 | B2 | 9/2010 | Qin et al. | |
| 7,811,119 | B2 | 10/2010 | Caveney et al. | |
| 7,814,240 | B2 | 10/2010 | Salgado et al. | |
| 7,867,017 | B1 | 1/2011 | Chen | |
| 7,869,426 | B2 | 1/2011 | Hough et al. | |
| 7,872,738 | B2 | 1/2011 | Abbott | |
| 7,880,475 | B2 | 2/2011 | Crumlin et al. | |
| 8,142,221 | B2 * | 3/2012 | Malstron et al. | 439/489 |
| 8,157,582 | B2 | 4/2012 | Frey et al. | |
| 2002/0008613 | A1 | 1/2002 | Nathan et al. | |
| 2004/0052498 | A1 | 3/2004 | Colombo et al. | |
| 2004/0240807 | A1 | 12/2004 | Frohlich et al. | |
| 2006/0148279 | A1 | 7/2006 | German et al. | |
| 2006/0160395 | A1 | 7/2006 | Macauley et al. | |
| 2007/0237470 | A1 | 10/2007 | Aronson et al. | |
| 2007/0254529 | A1 | 11/2007 | Pepe et al. | |
| 2008/0090454 | A1 | 4/2008 | Hoath et al. | |
| 2008/0100467 | A1 | 5/2008 | Downie et al. | |
| 2009/0097846 | A1 | 4/2009 | Kozischek et al. | |
| 2009/0098763 | A1 | 4/2009 | Below et al. | |
| 2009/0166404 | A1 | 7/2009 | German et al. | |
| 2009/0215310 | A1 | 8/2009 | Hoath et al. | |
| 2009/0232455 | A1 | 9/2009 | Nhep | |
| 2010/0211664 | A1 | 8/2010 | Raza et al. | |
| 2010/0211665 | A1 | 8/2010 | Raza et al. | |
| 2010/0211697 | A1 | 8/2010 | Raza et al. | |
| 2010/0215049 | A1 | 8/2010 | Raza et al. | |
| 2011/0092100 | A1 * | 4/2011 | Coffey et al. | 439/620.22 |
| 2011/0115494 | A1 * | 5/2011 | Taylor et al. | 324/537 |
| 2012/0088412 | A1 * | 4/2012 | Mattson et al. | 439/660 |
| 2012/0146660 | A1 * | 6/2012 | Mattson | 324/538 |
| 2012/0184141 | A1 * | 7/2012 | Mattson | 439/620.21 |
| 2012/0208401 | A1 * | 8/2012 | Petersen | 439/620.22 |
| 2012/0322310 | A1 * | 12/2012 | Taylor | 439/620.23 |

FOREIGN PATENT DOCUMENTS

| | | | |
|---|---|---|---|
| DE | 10 2004 033 940 | A1 | 2/2006 |
| GB | 2 236 398 | A | 4/1991 |
| WO | WO 02/47215 | A1 | 6/2002 |
| WO | WO 2010/001400 | A1 | 1/2010 |
| WO | WO 2010/081186 | A1 | 7/2010 |
| WO | WO 2010/121639 | A1 | 10/2010 |

OTHER PUBLICATIONS

*Avaya's Enhanced SYSTIMAX® iPatch System Enables IT Managers to Optimise Network Efficiency and Cut Downtime*, Press Release, May 20, 2003, obtained from http://www.avaya.com/usa/about-avaya/newsroom/news-releases/2003/pr-030520 on Jan. 7, 2009.

*Intelligent patching systems carving out a 'large' niche*, Cabling Installation & Maintenance, vol. 12, Issue 7, Jul. 2004 (5 pages).

(56) References Cited

OTHER PUBLICATIONS

*intelliMAC: The intelligent way to make Moves, Adds or Changes!* NORDX/CDT © 2003 (6 pages).
International Search Report and Written Opinion for PCT/US2010/052872 mailed Jan. 12, 2011.
International Search Report and Written Opinion for PCT/US2010/053228 mailed Mar. 28, 2011.
Invitation to Pay Additional Fees with Partial International Search for PCT/US2010/053228 mailed Feb. 14, 2011.
iTRACS Physical Layer Manager FAQ, obtained on Jun. 11, 2008 from http://www.itracs.com/products/physical-layer-manager-faqs.html (6 pages).
Meredith, L., "Managers missing point of intelligent patching," *Daa Center News*, Jun. 21, 2005, obtained Dec. 2, 2008 from http://searchdatacenter.techtarget.com/news/article/0,289142,sid80_gcil099991,00.html.
Ohtsuki, F. et al., "Design of Optical Connectors with ID Modules," *Electronics and Communications in Japan*, Part 1, vol. 77, No. 2, pp. 94-105 (Feb. 1994).
*SYSTIMAX® iPatch System Wins Platinum Network of the Year Award*, Press Release, Jan. 30, 2003, obtained from http://www.avaya.com/usa/about-avaya/newsroom/news-releases/2003/pr-030130a on Jan. 7, 2009.
TrueNet; TFP Series Rack Mount Fiber Panels, Spec Sheet; May 2008; 8 pages.

* cited by examiner

ELECTRICAL PLUG WITH MAIN CONTACTS AND RETRACTABLE SECONDARY CONTACTS

CROSS-REFERENCE

This application claims the benefit of U.S. Provisional Application Ser. No. 61/381,241, filed Sep. 9, 2010, which application is hereby incorporated by reference herein.

BACKGROUND

In communications infrastructure installations, a variety of communications devices can be used for switching, cross-connecting, and interconnecting communications signal transmission paths in a communications network. Some such communications devices are installed in one or more equipment racks to permit organized, high-density installations to be achieved in limited space available for equipment.

Communications devices can be organized into communications networks, which typically include numerous logical communication links between various items of equipment. Often a single logical communication link is implemented using several pieces of physical communication media. For example, a logical communication link between a computer and an inter-networking device such as a hub or router can be implemented as follows. A first cable connects the computer to a jack mounted in a wall. A second cable connects the wall-mounted jack to a port of a patch panel, and a third cable connects the inter-networking device to another port of a patch panel. A "patch cord" cross-connects the two together. In other words, a single logical communication link is often implemented using several segments of physical communication media.

Network management systems (NMS) are typically aware of logical communication links that exist in a communications network, but typically do not have information about the specific physical layer media (e.g., the communications devices, cables, couplers, etc.) that are used to implement the logical communication links. Indeed, NMS systems typically do not have the ability to display or otherwise provide information about how logical communication links are implemented at the physical layer level.

SUMMARY

The present disclosure relates to communications connector assemblies and arrangements that provide physical layer information (PLI) functionality as well as physical layer management (PLM) capabilities. In accordance with certain aspects, the disclosure relates to connector arrangements having primary contact arrangements for communication transmission and retractable secondary contact arrangements for data transmission.

BRIEF DESCRIPTION OF THE DRAWINGS

The accompanying drawings, which are incorporated in and constitute a part of the description, illustrate several aspects of the present disclosure. A brief description of the drawings is as follows.

DETAILED DESCRIPTION

Figure 1:
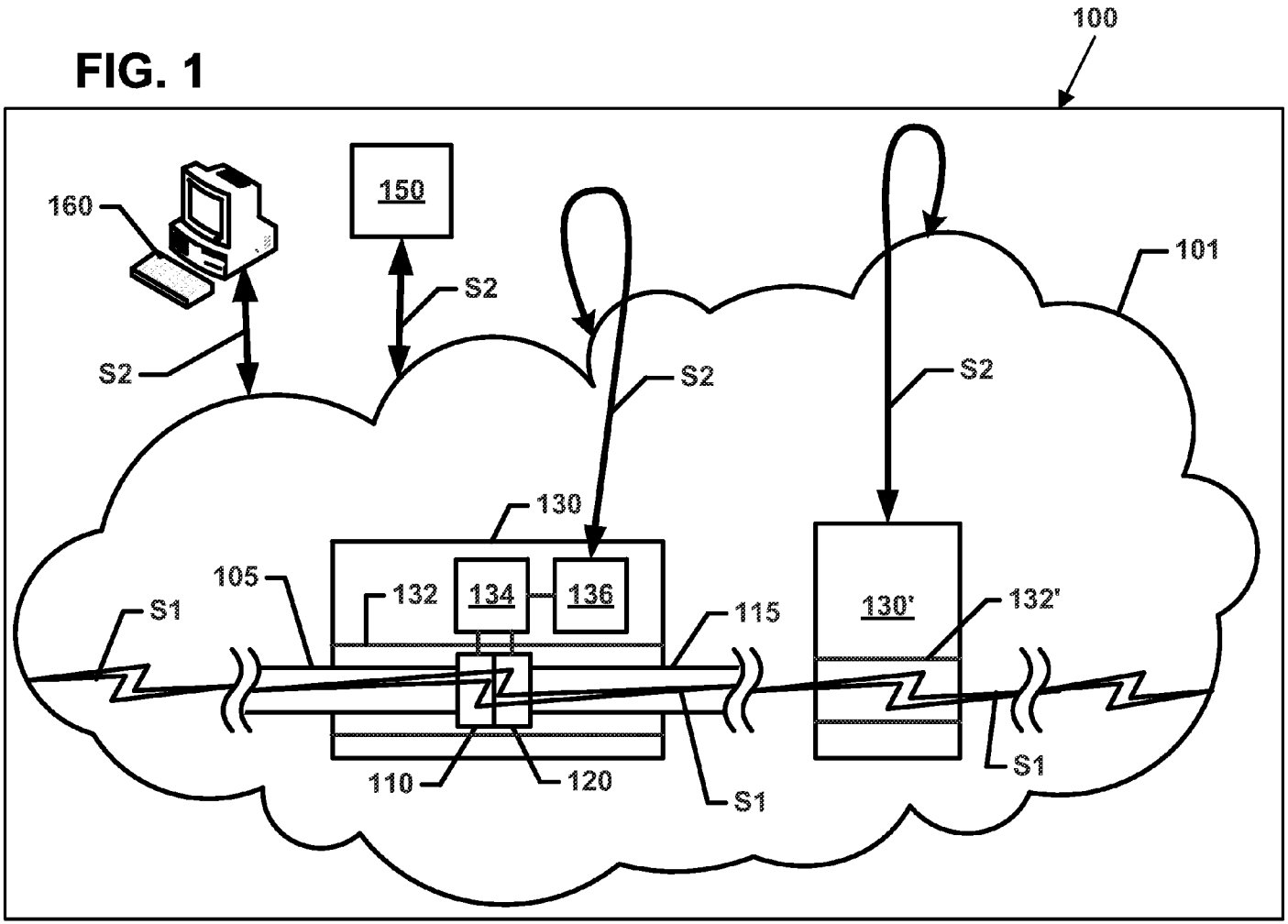
FIG. 1 is a diagram of a portion of an example communications and data management system in accordance with aspects of the present disclosure.

FIG. 1 is a diagram of a portion of an example communications and data management system 100. The example system 100 shown in FIG. 1 includes a part of a communications network 101 along which communications signals S1 pass. In one example implementation, the network 101 can include an Internet Protocol network. In other implementations, however, the communications network 101 may include other types of networks.

The communications network 101 includes interconnected network components (e.g., connector assemblies, inter-networking devices, internet working devices, servers, outlets, and end user equipment (e.g., computers)). In one example implementation, communications signals S1 pass from a computer to a wall outlet to a port of communication panel, to a first port of an inter-networking device, out another port of the inter-networking device, to a port of the same or another communications panel, to a rack mounted server.

The portion of the communications network 101 shown in FIG. 1 includes first and second connector assemblies 130, 130' at which communications signals S1 pass from one portion of the communications network 101 to another portion of the communications network 101. Non-limiting examples of connector assemblies 130, 130' include, for example, rack-mounted connector assemblies (e.g., patch panels, distribution units, and media converters for fiber and copper physical communication media), wall-mounted connector assemblies (e.g., boxes, jacks, outlets, and media converters for fiber and copper physical communication media), and inter-networking devices (e.g., switches, routers, hubs, repeaters, gateways, and access points). In the example shown, the first connector assembly 130 defines at least one port 132 configured to communicatively couple at least a first media segment 105 to at least a second media segment 115 to enable the communication signals S1 to pass between the media segments 105, 115.

The at least one port 132 of the first connector assembly 130 may be directly connected to a port 132' of the second connector assembly 130'. As the term is used herein, the port 132 is directly connected to the port 132' when the communications signals S1 pass between the two ports 132, 132' without passing through an intermediate port. For example, routing a patchcord between port 132 and port 132' directly connects the ports 132, 132'.

The port 132 of the first connector assembly 130 also may be indirectly connected to the port 132' of the second connector assembly 130'. As the term is used herein, the port 132 is indirectly connected to the port 132' when the communications signals S1 pass through an intermediate port when traveling between the ports 132, 132'. For example, in one implementation, the communications signals S1 may be routed over one media segment from the port 132 at the first connector assembly 130 to a port of a third connector assembly at which the media segment is coupled to another media segment that is routed from the port of the third connector assembly to the port 132' of the second connector assembly 130'.

Non-limiting examples of media segments include optical fibers, which carry optical data signals, and electrical conductors (e.g., CAT-5, 6, and 7 twisted-pair cables), which carry electrical data signals. Media segments also can include electrical plugs, fiber optic connectors (e.g., SC, LC, FC, LX.5, or MPO connectors), adapters, media converters, and other physical components terminating to the fibers, conductors, or other such media segments. The techniques described here also can be used with other types of connectors including, for example, BNC connectors, F connectors, DSX jacks and plugs, bantam jacks and plugs.

In the example shown, each media segment 105, 115 is terminated at a plug or connector 110, 120, respectively, which is configured to communicatively connect the media segments 105, 115. For example, in one implementation, the port 132 of the connector assembly 130 can be configured to align ferrules of two fiber optic connectors 110, 120. In another implementation, the port 132 of the connector assembly 130 can be configured to electrically connect an electrical plug with an electrical socket (e.g., a jack). In yet another implementation, the port 132 can include a media converter configured to connect an optical fiber to an electrical conductor.

In accordance with some aspects, the connector assembly 130 does not actively manage (e.g., is passive with respect to) the communications signals S1 passing through port 132. For example, in some implementations, the connector assembly 130 does not modify the communications signal S1 carried over the media segments 105, 115. Further, in some implementations, the connector assembly 130 does not read, store, or analyze the communications signal S1 carried over the media segments 105, 115.

In accordance with aspects of the disclosure, the communications and data management system 100 also provides physical layer information (PLI) functionality as well as physical layer management (PLM) functionality. As the term is used herein, "PLI functionality" refers to the ability of a physical component or system to identify or otherwise associate physical layer information with some or all of the physical components used to implement the physical layer of the system. As the term is used herein, "PLM functionality" refers to the ability of a component or system to manipulate or to enable others to manipulate the physical components used to implement the physical layer of the system (e.g., to track what is connected to each component, to trace connections that are made using the components, or to provide visual indications to a user at a selected component).

As the term is used herein, "physical layer information" refers to information about the identity, attributes, and/or status of the physical components used to implement the physical layer of the communications system 101. In accordance with some aspects, physical layer information of the communications system 101 can include media information, device information, and location information.

As the term is used herein, "media information" refers to physical layer information pertaining to cables, plugs, connectors, and other such media segments. In accordance with some aspects, the media information is stored on or in the media segments, themselves. In accordance with other aspects, the media information can be stored at one or more data repositories for the communications system, either alternatively or in addition to the media, themselves. Non-limiting examples of media information include a part number, a serial number, a plug or other connector type, a conductor or fiber type, a cable or fiber length, cable polarity, a cable or fiber pass-through capacity, a date of manufacture, a manufacturing lot number, information about one or more visual attributes of physical communication media (e.g., information about the color or shape of the physical communication media or an image of the physical communication media), and an insertion count (i.e., a record of the number of times the media segment has been connected to another media segment or network component). Media information also can include testing or media quality or performance information. The testing or media quality or performance information, for example, can be the results of testing that is performed when a particular segment of media is manufactured.

As the term is used herein, "device information" refers to physical layer information pertaining to the communications panels, inter-networking devices, media converters, computers, servers, wall outlets, and other physical communications devices to which the media segments attach. In accordance with some aspects, the device information is stored on or in the devices, themselves. In accordance with other aspects, the device information can be stored at one or more data repositories for the communications system, either alternatively or in addition to the devices, themselves. Non-limiting examples of device information include a device identifier, a device type, port priority data (that associates a priority level with each port), and port updates (described in more detail herein).

As the term is used herein, "location information" refers to physical layer information pertaining to a physical layout of a building or buildings in which the network 101 is deployed. Location information also can include information indicating where each communications device, media segment, network component, or other component that is physically located within the building. In accordance with some aspects, the location information of each system component is stored on or in the respective component. In accordance with other aspects, the location information can be stored at one or more data repositories for the communications system, either alternatively or in addition to the system components, themselves.

In accordance with some aspects, one or more of the components of the communications network 101 is configured to store physical layer information pertaining to the component as will be disclosed in more detail herein. In FIG. 1, the connectors 110, 120, the media segments 105, 115, and/or the connector assemblies 130, 130' may store physical layer information. For example, in FIG. 1, each connector 110, 120 may store information pertaining to itself (e.g., type of connector, data of manufacture, etc.) and/or to the respective media segment 105, 115 (e.g., type of media, test results, etc.).

In another example implementation, the media segments 105, 115 or connectors 110, 120 may store media information that includes a count of the number of times that the media segment (or connector) has been inserted into port 132. In such an example, the count stored in or on the media segment is updated each time the segment (or plug or connector) is inserted into port 132. This insertion count value can be used, for example, for warranty purposes (e.g., to determine if the connector has been inserted more than the number of times specified in the warranty) or for security purposes (e.g., to detect unauthorized insertions of the physical communication media).

In accordance with certain aspects, one or more of the components of the communications network 101 also can read the physical layer information from one or more media segments retained thereat. In certain implementations, one or more network components includes a media reading interface that is configured to read physical layer information stored on or in the media segments or connectors attached thereto. For example, in one implementation, the connector assembly 130 includes a media reading interface 134 that can read media information stored on the media cables 105, 115 retained within the port 132. In another implementation, the media reading interface 134 can read media information stored on the connectors or plugs 110, 120 terminating the cables 105, 115, respectively.

In some implementations, some types of physical layer information can be obtained by the connector assembly 130 from a user at the connector assembly 130 via a user interface (e.g., a keypad, a scanner, a touch screen, buttons, etc.). The connector assembly 130 can provide the physical layer information obtained from the user to other devices or systems that are coupled to the network 101 (as described in more detail herein). In other implementations, some or all physical layer information can be obtained by the connector assembly 130 from other devices or systems that are coupled to the network 101. For example, physical layer information pertaining to media that is not configured to store such information can be entered manually into another device or system that is coupled to the network 101 (e.g., at the connector assembly 130, at the computer 160, or at the aggregation point 150).

In some implementations, some types of non-physical layer information (e.g., network information) can be obtained by one network component from other devices or systems that are coupled to the network 101. For example, the connector assembly 130 may pull non-physical layer information from one or more components of the network 101. In other implementations, the non-physical layer information can be obtained by the connector assembly 130 from a user at the connector assembly 130.

In accordance with some aspects of the disclosure, the physical layer information read by a network component may be processed or stored at the component. For example, in certain implementations, the first connector assembly 130 shown in FIG. 1 is configured to read physical layer information stored on the connectors 110, 120 and/or on the media segments 105, 115 using media reading interface 134. Accordingly, in FIG. 1, the first connector assembly 130 may store not only physical layer information about itself (e.g., the total number of available ports at that assembly 130, the number of ports currently in use, etc.), but also physical layer information about the connectors 110, 120 inserted at the ports and/or about the media segments 105, 115 attached to the connectors 110, 120.

In some implementations, the connector assembly 130 is configured to add, delete, and/or change the physical layer information stored in or on the segment of physical communication media 105, 115 (i.e., or the associated connectors 110, 120). For example, in some implementations, the media information stored in or on the segment of physical communication media 105, 115 can be updated to include the results of testing that is performed when a segment of physical media is installed or otherwise checked. In other implementations, such testing information is supplied to the aggregation point 150 for storage and/or processing. In some implementations, modification of the physical layer information does not affect the communications signals S1 passing through the connector assembly 130.

In other implementations, the physical layer information obtained by the media reading interface (e.g., interface 134 of FIG. 1) may be communicated (see PLI signals S2) over the network 101 for processing and/or storage. The components of the communications network 101 are connected to one or more aggregation devices 150 (described in greater detail herein) and/or to one or more computing systems 160. For example, in the implementation shown in FIG. 1, each connector assembly 130 includes a PLI port 136 that is separate from the "normal" ports 132 of the connector assembly 130. Physical layer information is communicated between the connector assembly 130 and the network 101 through the PLI port 136. In the example shown in FIG. 1, the connector assembly 130 is connected to a representative aggregation device 150, a representative computing system 160, and to other components of the network 101 (see looped arrow) via the PLI port 136.

The physical layer information is communicated over the network 101 just like any other data that is communicated over the network 101, while at the same time not affecting the communication signals S1 that pass through the connector assembly 130 on the normal ports 132. Indeed, in some implementations, the physical layer information may be communicated as one or more of the communication signals S1 that pass through the normal ports 132 of the connector assemblies 130, 130'. For example, in one implementation, a media segment may be routed between the PLI port 136 and one of the "normal" ports 132. In such an implementation, the physical layer information may be passed along the communications network 101 to other components of the communications network 101 (e.g., to the one or more aggregation points 150 and/or to the one or more computer systems 160). By using the network 101 to communicate physical layer information pertaining to it, an entirely separate network need not be provided and maintained in order to communicate such physical layer information.

In other implementations, however, the communications network 101 includes a data network along which the physical layer information described above is communicated. At least some of the media segments and other components of the data network may be separate from those of the communications network 101 to which such physical layer information pertains. For example, in some implementations, the first connector assembly 130 may include a plurality of fiber optic adapters defining ports at which connectorized optical fibers are optically coupled together to create an optical path for communications signals S1. The first connector assembly 130 also may include one or more electrical cable ports at which the physical layer information (see PLI signals S2) are passed to other parts of the data network. (e.g., to the one or more aggregation points 150 and/or to the one or more computer systems 160).

Figure 2:
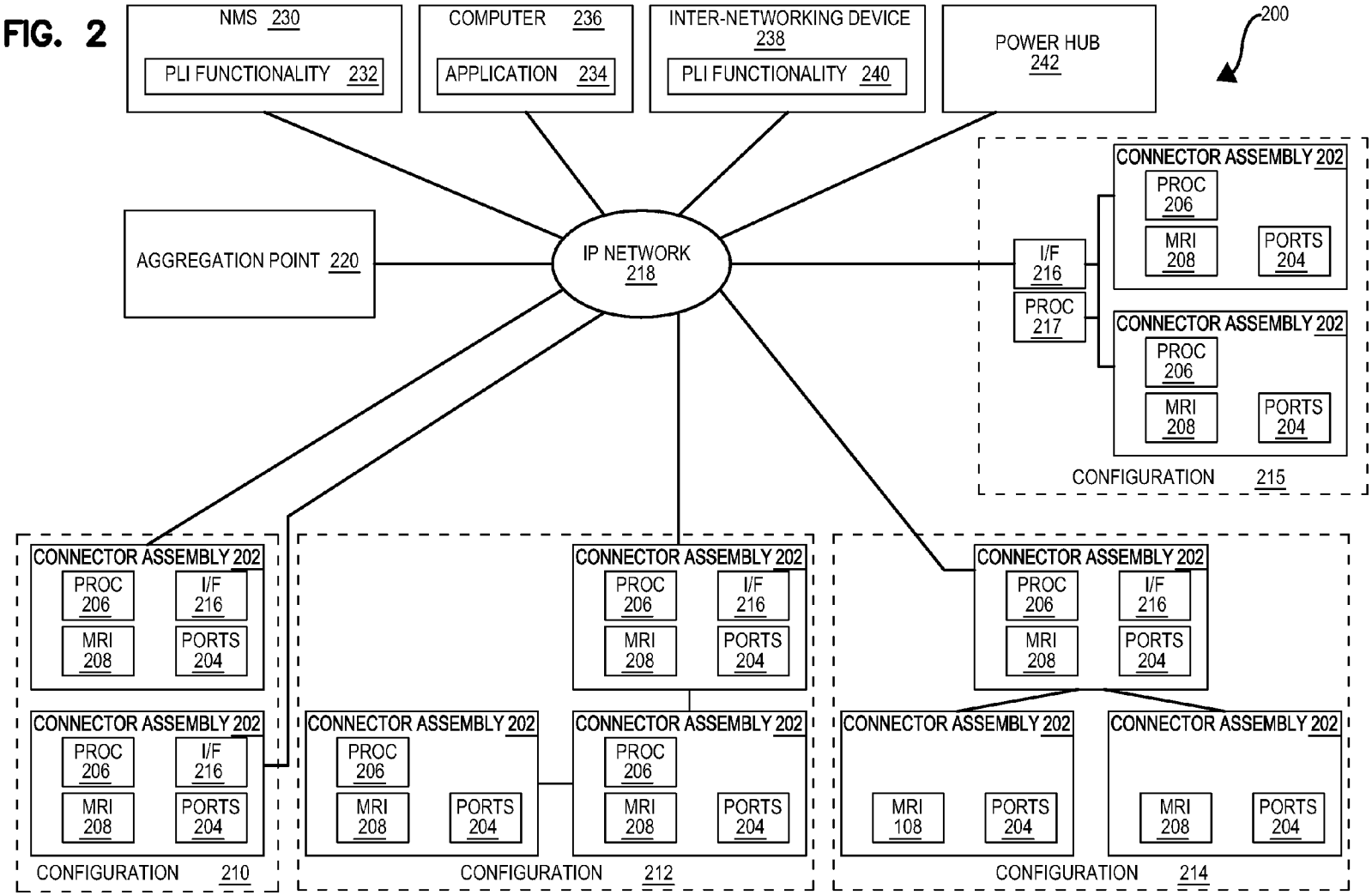
FIG. 2 is a block diagram of one implementation of a communications management system that includes PLI functionality as well as PLM functionality in accordance with aspects of the present disclosure.

FIG. 2 is a block diagram of one example implementation of a communications management system 200 that includes PLI functionality as well as PLM functionality. The management system 200 comprises a plurality of connector assemblies 202. The system 200 includes one or more connector assemblies 202 connected to an IP network 218. The connector assemblies 202 shown in FIG. 2 illustrate various implementations of the connector assembly 130 of FIG. 1.

Each connector assembly 202 includes one or more ports 204, each of which is used to connect two or more segments of physical communication media to one another (e.g., to implement a portion of a logical communication link for communication signals S1 of FIG. 1). At least some of the connector assemblies 202 are designed for use with segments of physical communication media that have physical layer information stored in or on them. The physical layer information is stored in or on the segment of physical communication media in a manner that enables the stored information, when the segment is attached to a port 204, to be read by a programmable processor 206 associated with the connector assembly 202.

In the particular implementation shown in FIG. 2, each of the ports 204 of the connector assemblies 202 comprises a respective media reading interface 208 via which the respective programmable processor 206 is able to determine if a physical communication media segment is attached to that port 204 and, if one is, to read the physical layer information stored in or on the attached segment (if such media information is stored therein or thereon). The programmable processor 206 associated with each connector assembly 202 is communicatively coupled to each of the media reading interfaces 208 using a suitable bus or other interconnect (not shown).

In the particular implementation shown in FIG. 2, four example types of connector assembly configurations are shown. In the first connector assembly configuration 210 shown in FIG. 2, each connector assembly 202 includes its own respective programmable processor 206 and its own respective network interface 216 that is used to communicatively couple that connector assembly 202 to an Internet Protocol (IP) network 218.

In the second type of connector assembly configuration 212, a group of connector assemblies 202 are physically located near each other (e.g., in a bay or equipment closet). Each of the connector assemblies 202 in the group includes its own respective programmable processor 206. However, in the second connector assembly configuration 212, some of the connector assemblies 202 (referred to here as "interfaced connector assemblies") include their own respective network interfaces 216 while some of the connector assemblies 202 (referred to here as "non-interfaced connector assemblies") do not. The non-interfaced connector assemblies 202 are communicatively coupled to one or more of the interfaced connector assemblies 202 in the group via local connections. In this way, the non-interfaced connector assemblies 202 are communicatively coupled to the IP network 218 via the network interface 216 included in one or more of the interfaced connector assemblies 202 in the group. In the second type of connector assembly configuration 212, the total number of network interfaces 216 used to couple the connector assemblies 202 to the IP network 218 can be reduced. Moreover, in the particular implementation shown in FIG. 2, the non-interfaced connector assemblies 202 are connected to the interfaced connector assembly 202 using a daisy chain topology (though other topologies can be used in other implementations and embodiments).

In the third type of connector assembly configuration 214, a group of connector assemblies 202 are physically located near each other (e.g., within a bay or equipment closet). Some of the connector assemblies 202 in the group (also referred to here as "master" connector assemblies 202) include both their own programmable processors 206 and network interfaces 216, while some of the connector assemblies 202 (also referred to here as "slave" connector assemblies 202) do not include their own programmable processors 206 or network interfaces 216. Each of the slave connector assemblies 202 is communicatively coupled to one or more of the master connector assemblies 202 in the group via one or more local connections. The programmable processor 206 in each of the master connector assemblies 202 is able to carry out the PLM functions for both the master connector assembly 202 of which it is a part and any slave connector assemblies 202 to which the master connector assembly 202 is connected via the local connections. As a result, the cost associated with the slave connector assemblies 202 can be reduced. In the particular implementation shown in FIG. 2, the slave connector assemblies 202 are connected to a master connector assembly 202 in a star topology (though other topologies can be used in other implementations and embodiments).

Each programmable processor 206 is configured to execute software or firmware that causes the programmable processor 206 to carry out various functions described below. Each programmable processor 206 also includes suitable memory (not shown) that is coupled to the programmable processor 206 for storing program instructions and data. In general, the programmable processor 206 determines if a physical communication media segment is attached to a port 204 with which that processor 206 is associated and, if one is, to read the identifier and attribute information stored in or on the attached physical communication media segment (if the segment includes such information stored therein or thereon) using the associated media reading interface 208.

In the fourth type of connector assembly configuration 215, a group of connector assemblies 202 are housed within a common chassis or other enclosure. Each of the connector assemblies 202 in the configuration 215 includes their own programmable processors 206. In the context of this configuration 215, the programmable processors 206 in each of the connector assemblies are "slave" processors 206. Each of the slave programmable processor 206 is also communicatively coupled to a common "master" programmable processor 217 (e.g., over a backplane included in the chassis or enclosure). The master programmable processor 217 is coupled to a network interface 216 that is used to communicatively couple the master programmable processor 217 to the IP network 218.

In this configuration 215, each slave programmable processor 206 is configured to determine if physical communication media segments are attached to its port 204 and to read the physical layer information stored in or on the attached physical communication media segments (if the attached segments have such information stored therein or thereon) using the associated media reading interfaces 208. The physical layer information is communicated from the slave programmable processor 206 in each of the connector assemblies 202 in the chassis to the master processor 217. The master processor 217 is configured to handle the processing associated with communicating the physical layer information read from by the slave processors 206 to devices that are coupled to the IP network 218.

The system 200 includes functionality that enables the physical layer information that the connector assemblies 202 capture to be used by application-layer functionality outside of the traditional physical-layer management application domain. That is, the physical layer information is not retained in a PLM "island" used only for PLM purposes but is instead made available to other applications. In the particular implementation shown in FIG. 2, the management system 200 includes an aggregation point 220 that is communicatively coupled to the connector assemblies 202 via the IP network 218.

The aggregation point 220 includes functionality that obtains physical layer information from the connector assemblies 202 (and other devices) and stores the physical layer information in a data store. The aggregation point 220 can be used to receive physical layer information from various types of connector assemblies 202 that have functionality for automatically reading information stored in or on the segment of physical communication media. Also, the aggregation point 220 and aggregation functionality 224 can be used to receive physical layer information from other types of devices that have functionality for automatically reading information stored in or on the segment of physical communication media. Examples of such devices include end-user devices—such as computers, peripherals (e.g., printers, copiers, storage devices, and scanners), and IP telephones—that include functionality for automatically reading information stored in or on the segment of physical communication media.

The aggregation point 220 also can be used to obtain other types of physical layer information. For example, in this implementation, the aggregation point 220 also obtains information about physical communication media segments that is not otherwise automatically communicated to an aggregation point 220. This information can be provided to the aggregation point 220, for example, by manually entering such information into a file (e.g., a spreadsheet) and then uploading the file to the aggregation point 220 (e.g., using a web browser) in connection with the initial installation of each of the various items. Such information can also, for example, be directly entered using a user interface provided by the aggregation point 220 (e.g., using a web browser).

The aggregation point 220 also includes functionality that provides an interface for external devices or entities to access the physical layer information maintained by the aggregation point 220. This access can include retrieving information from the aggregation point 220 as well as supplying information to the aggregation point 220. In this implementation, the aggregation point 220 is implemented as "middleware" that is able to provide such external devices and entities with transparent and convenient access to the PLI maintained by the access point 220. Because the aggregation point 220 aggregates PLI from the relevant devices on the IP network 218 and provides external devices and entities with access to such PLI, the external devices and entities do not need to individually interact with all of the devices in the IP network 218 that provide PLI, nor do such devices need to have the capacity to respond to requests from such external devices and entities.

For example, as shown in FIG. 2, a network management system (NMS) 230 includes PLI functionality 232 that is configured to retrieve physical layer information from the aggregation point 220 and provide it to the other parts of the NMS 230 for use thereby. The NMS 230 uses the retrieved physical layer information to perform one or more network management functions. The NMS 230 communicates with the aggregation point 220 over the IP network 218.

As shown in FIG. 2, an application 234 executing on a computer 236 can also use the API implemented by the aggregation point 220 to access the PLI information maintained by the aggregation point 220 (e.g., to retrieve such information from the aggregation point 220 and/or to supply such information to the aggregation point 220). The computer 236 is coupled to the IP network 218 and accesses the aggregation point 220 over the IP network 218.

In the example shown in FIG. 2, one or more inter-networking devices 238 used to implement the IP network 218 include physical layer information (PLI) functionality 240. The PLI functionality 240 of the inter-networking device 238 is configured to retrieve physical layer information from the aggregation point 220 and use the retrieved physical layer information to perform one or more inter-networking functions. Examples of inter-networking functions include Layer 1, Layer 2, and Layer 3 (of the OSI model) inter-networking functions such as the routing, switching, repeating, bridging, and grooming of communication traffic that is received at the inter-networking device.

The aggregation point 220 can be implemented on a standalone network node (e.g., a standalone computer running appropriate software) or can be integrated along with other network functionality (e.g., integrated with an element management system or network management system or other network server or network element). Moreover, the functionality of the aggregation point 220 can be distribute across many nodes and devices in the network and/or implemented, for example, in a hierarchical manner (e.g., with many levels of aggregation points). The IP network 218 can include one or more local area networks and/or wide area networks (e.g., the Internet). As a result, the aggregation point 220, NMS 230, and computer 236 need not be located at the same site as each other or at the same site as the connector assemblies 202 or the inter-networking devices 238.

Also, power can be supplied to the connector assemblies 202 using conventional "Power over Ethernet" techniques specified in the IEEE 802.3af standard, which is hereby incorporated herein by reference. In such an implementation, a power hub 242 or other power supplying device (located near or incorporated into an inter-networking device that is coupled to each connector assembly 202) injects DC power onto one or more of the wires (also referred to here as the "power wires") included in the copper twisted-pair cable used to connect each connector assembly 202 to the associated inter-networking device.

Figure 3:
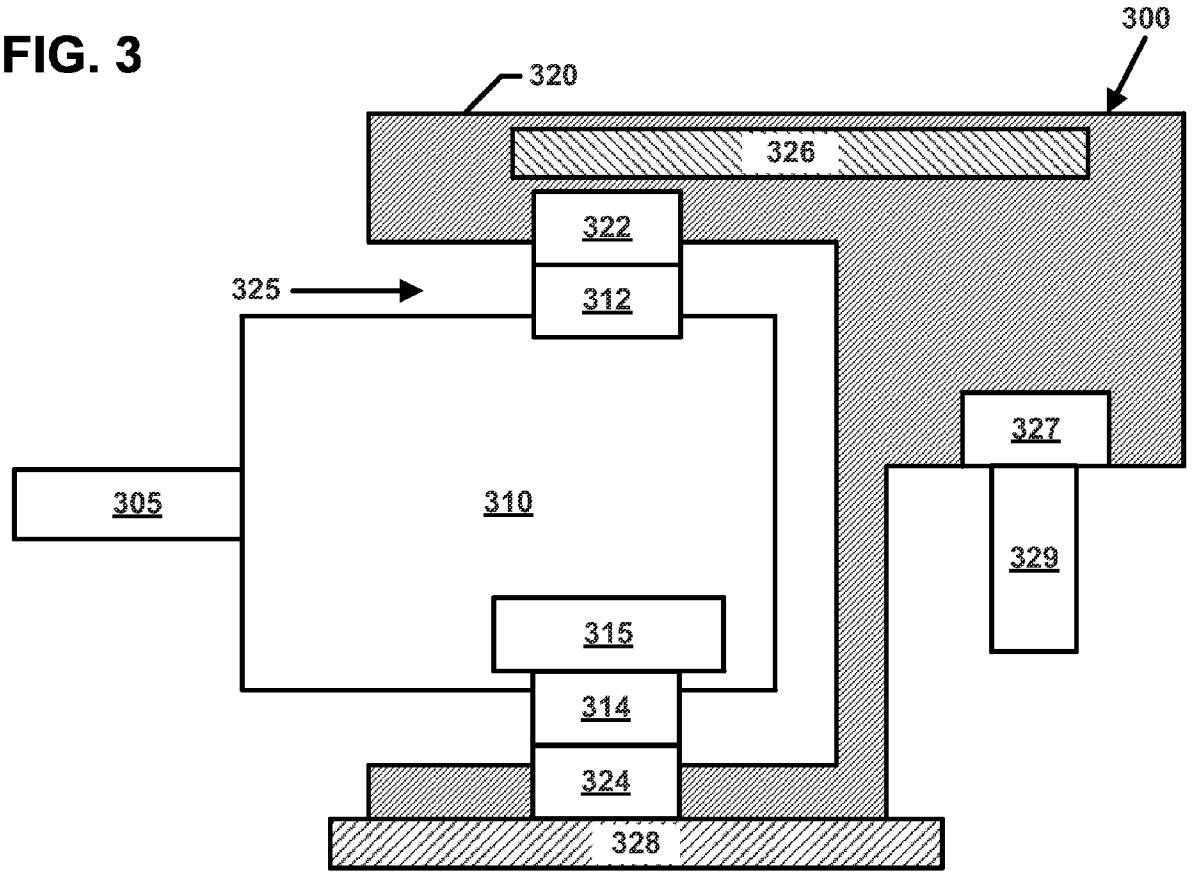
FIG. 3 is a block diagram of one high-level example of a port and media reading interface that are suitable for use in the management system of FIG. 2 in accordance with aspects of the present disclosure.

FIG. 3 is a schematic diagram of one example connection system 300 including a connector assembly 320 configured to collect physical layer information from a connector arrangement 310. The example connection system 300 shown includes a jack module 320 and an electrical plug 310. The connector arrangement 310 terminates at least a first electrical segment (e.g., a conductor cable) 305 of physical communications media and the connector assembly 320 terminates at least second electrical segments (e.g., twisted pairs of copper wires) 329 of physical communications media. The connector assembly 320 defines at least one socket port 325 in which the connector arrangement 310 can be accommodated.

Each electrical segment 305 of the connector arrangement 310 carries communication signals (e.g., communications signals S1 of FIG. 1) to primary contact members 312 on the connector arrangement 310. The connector assembly 320 includes a primary contact arrangement 322 that is accessible from the socket port 325. The primary contact arrangement 322 is aligned with and configured to interface with the primary contact members 312 to receive the communications signals (S1 of FIG. 1) from the primary contact members 312 when the connector arrangement 310 is inserted into the socket 325 of the connector assembly 320.

The connector assembly 320 is electrically coupled to one or more printed circuit boards. For example, the connector assembly 320 can support or enclose a first printed circuit board 326, which connects to insulation displacement contacts (IDCs) 327 or to another type of electrical contacts. The IDCs 327 terminate the electrical segments 329 of physical communications media (e.g., conductive wires). The first printed circuit board 326 manages the primary communication signals carried from the conductors terminating the cable 305 to the electrical segments 329 that couple to the IDCs 327.

In accordance with some aspects, the connector arrangement 310 can include a storage device 315 configured to store physical layer information. The connector arrangement 310 also includes second contact members 314 that are electrically coupled (i.e., or otherwise communicatively coupled) to the storage device 315. In one implementation, the storage device 315 is implemented using an EEPROM (e.g., a PCB surface-mount EEPROM). In other implementations, the storage device 315 is implemented using other non-volatile memory device. Each storage device 315 is arranged and configured so that it does not interfere or interact with the communications signals communicated over the media segment 305.

The connector assembly 320 also includes a second contact arrangement (e.g., a media reading interface) 324. In certain implementations, the media reading interface 324 is accessible through the socket port 325. The second contact arrangement 324 is aligned with and configured to interface with the second contact members 314 of the media segment to receive the physical layer information from the storage device 315 when the connector arrangement 310 is inserted into the socket 325 of the connector assembly 320.

In some such implementations, the storage device interfaces 314 and the media reading interfaces 324 each comprise three (3) leads—a power lead, a ground lead, and a data lead. The three leads of the storage device interface 314 come into electrical contact with three (3) corresponding leads of the media reading interface 324 when the corresponding media segment is inserted in the corresponding port 325. In certain example implementations, a two-line interface is used with a simple charge pump. In still other implementations, additional leads can be provided (e.g., for potential future applications). Accordingly, the storage device interfaces 314 and the media reading interfaces 324 may each include four (4) leads, five (5) leads, six (6) leads, etc.

The storage device 315 also may include a processor or micro-controller, in addition to the storage for the physical layer information. In some example implementations, the micro-controller can be used to execute software or firmware that, for example, performs an integrity test on the cable 305 (e.g., by performing a capacitance or impedance test on the sheathing or insulator that surrounds the cable 305, (which may include a metallic foil or metallic filler for such purposes)). In the event that a problem with the integrity of the cable 305 is detected, the micro-controller can communicate that fact to a programmable processor (e.g., processor 206 of FIG. 2) associated with the port using the storage device interface (e.g., by raising an interrupt). The micro-controller also can be used for other functions.

The connector assembly 320 also can support or enclose a second printed circuit board 328, which connects to the second contact arrangement 324. The second printed circuit board 328 manages the physical layer information communicated from a storage device 315 through second contacts 314, 324. In the example shown, the second printed circuit board 328 is positioned on an opposite side of the connector assembly 320 from the first printed circuit board 326. In other implementations, the printed circuit boards 326, 328 can be positioned on the same side or on different sides. In one implementation, the second printed circuit board 328 is positioned horizontally relative to the connector assembly 320 (see FIG. 3). In another implementation, the second printed circuit board 328 is positioned vertically relative to the connector assembly 320.

The second printed circuit board 328 can be communicatively connected to one or more programmable electronic processors and/or one or more network interfaces. In one implementation, one or more such processors and interfaces can be arranged as components on the printed circuit board 328. In another implementation, one of more such processor and interfaces can be arranged on a separate circuit board that is coupled to the second printed circuit board 328. For example, the second printed circuit board 328 can couple to other circuit boards via a card edge type connection, a connector-to-connector type connection, a cable connection, etc. The network interface is configured to send the physical layer information to the data network (e.g., see signals S2 of FIG. 1).

Figure 4:
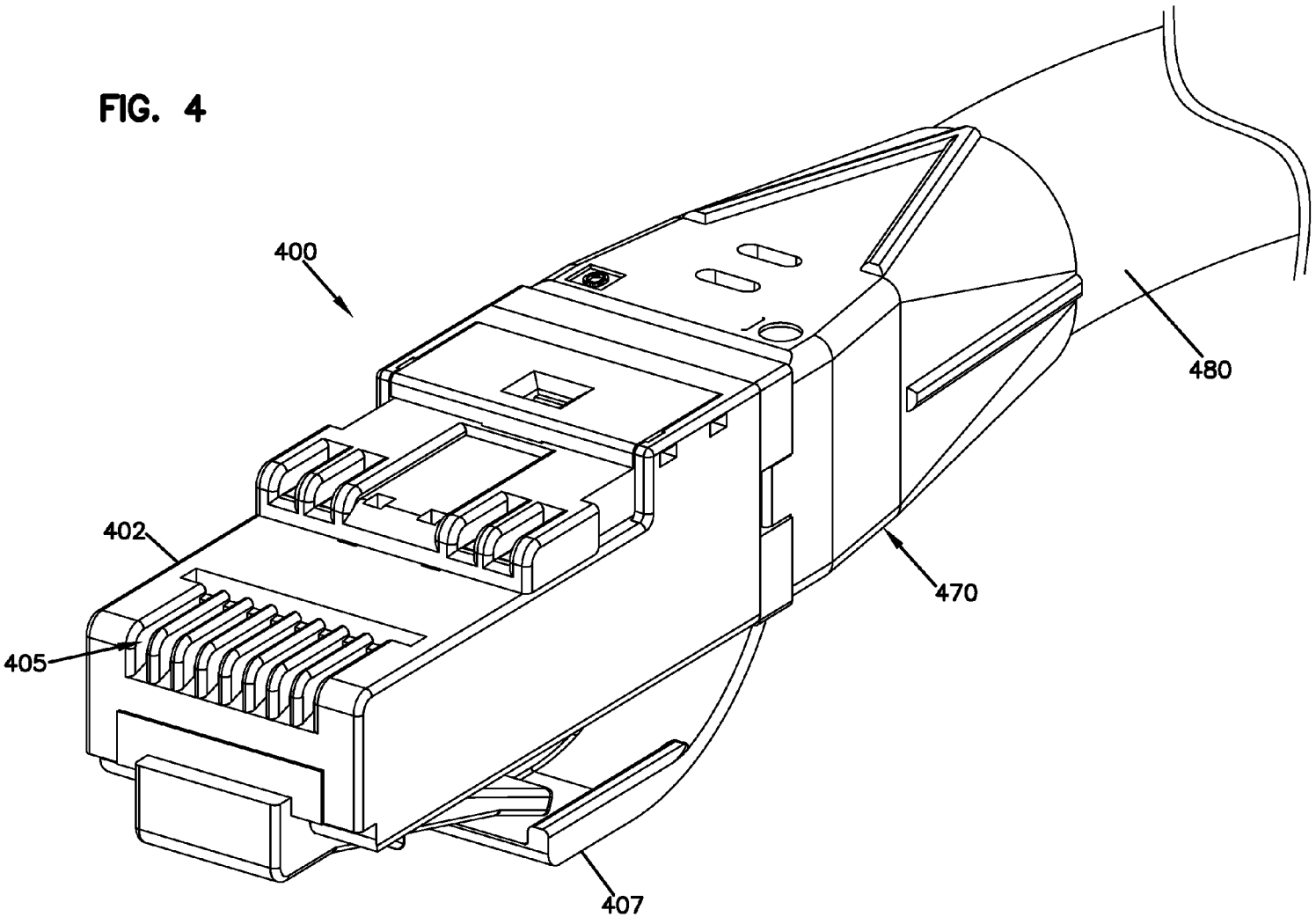
FIG. 4 is a top, front perspective view of an example plug connector including a storage component and secondary contacts in a forward position in accordance with aspects of the present disclosure.

FIGS. 4-54 provide an example implementation of components for communications (e.g., electrical communications) applications in physical layer management networks. FIGS. 4-11 show an example of a connector arrangement 400 in the form of a modular plug 402 for terminating one or more conductors of an electrical telecommunications cable 480 (FIG. 4). In the example shown, the modular plug 402 is an RJ plug that terminates a twisted pair copper cable.

The connector arrangement 400 includes a primary contact arrangement that is suitable to receive and convey primary communication signals S1 and a secondary contact arrangement that is suitable to receive and convey secondary signals S2 (see signals S1, S2 of FIG. 1). The primary contact arrangement is at a fixed location on the connector arrangement 400. The secondary contact arrangement is configured to move relative to the modular plug 402 and the primary contact arrangement.

Figure 10:
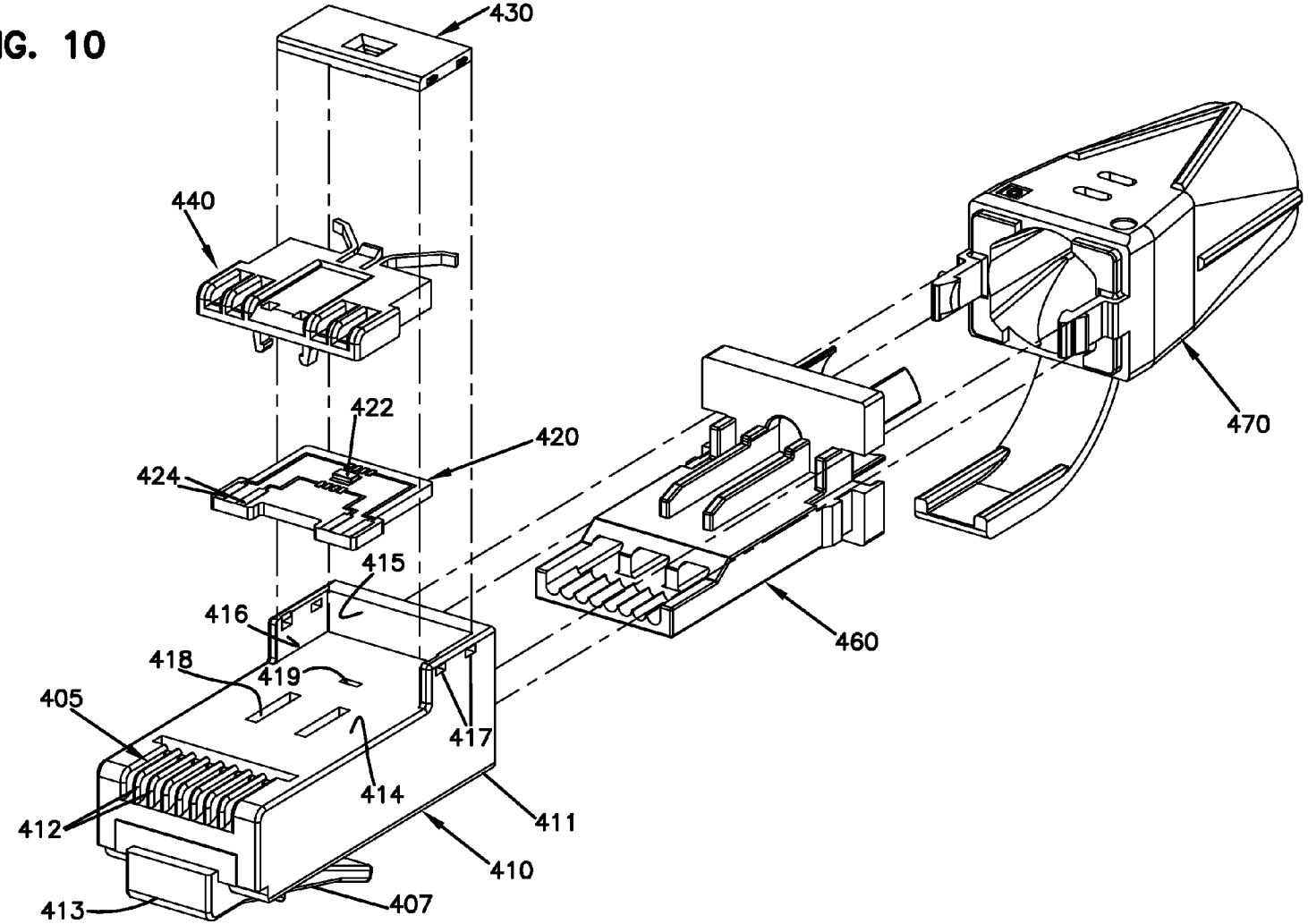
FIG. 10 is an exploded, perspective view of the example plug connector of FIG. 4 in which a storage component, a shroud, a cover, a wire manager, and a boot are visible, in accordance with aspects of the present disclosure.

As shown in FIG. 10, the plug 402 includes a plug nose 410 that connects to a wire manager 460 for managing the twisted wire pairs of the cable 480. The wire manager 460 connects to a strain relief boot 470 that encircles the cable 480. In one implementation, a shield can be mounted to the plug nose 410. For example, the shield can be snap-fit to the plug nose 410. A contact shroud 440 can be mounted to the plug nose 410 to retain the storage device 420 on the plug 402. In some implementations, a cover 430 can cooperate with the plug nose 410 to form a partial enclosure.

Figure 5:
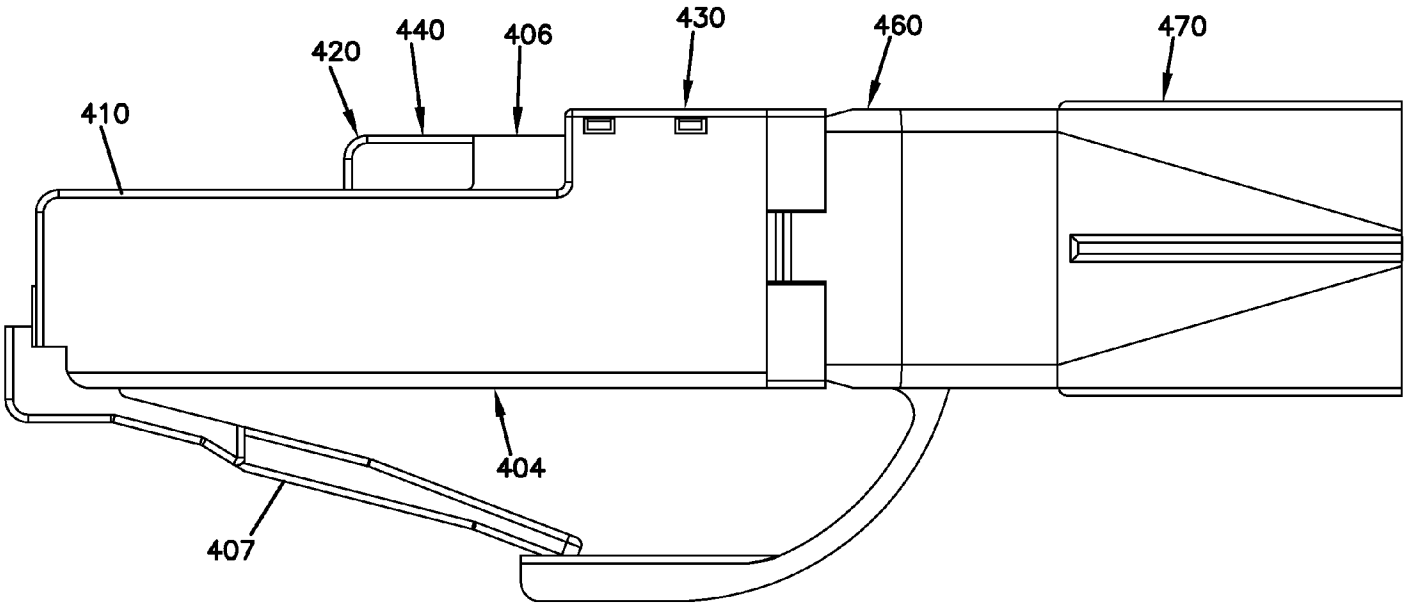
FIG. 5 is a side elevational view of the example plug connector of FIG. 4 in accordance with aspects of the present disclosure.
Figure 6:
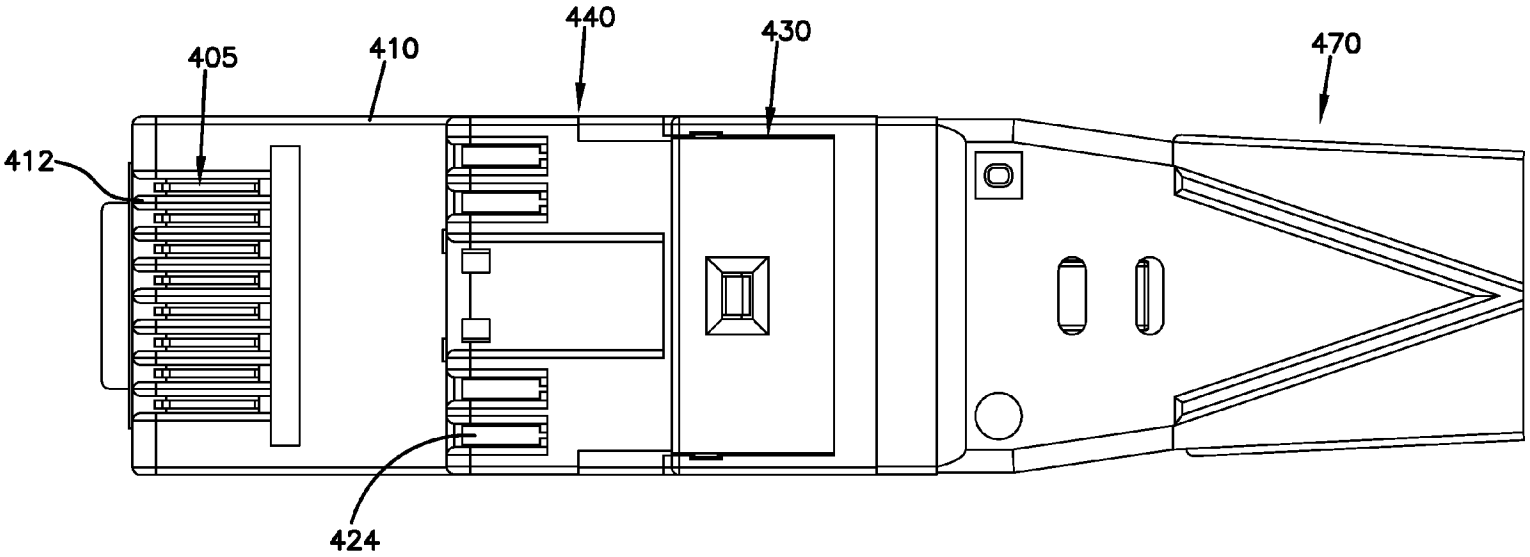
FIG. 6 is a top plan view of the example plug connector of FIG. 4 in accordance with aspects of the present disclosure.
Figure 7:
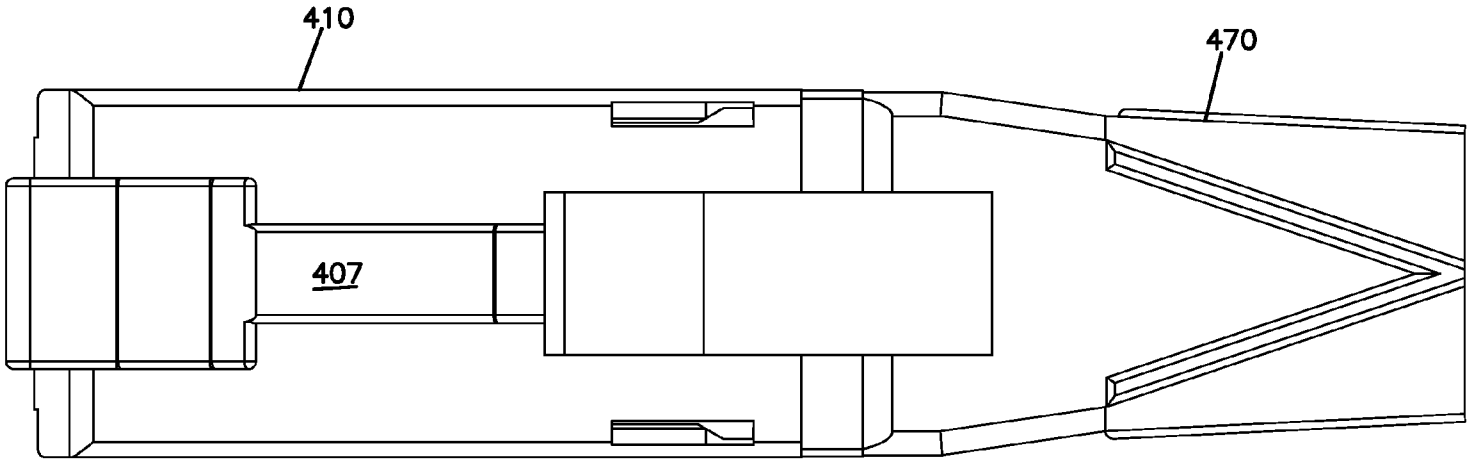
FIG. 7 is a bottom plan view of the example plug connector of FIG. 4 in accordance with aspects of the present disclosure.
Figure 8:
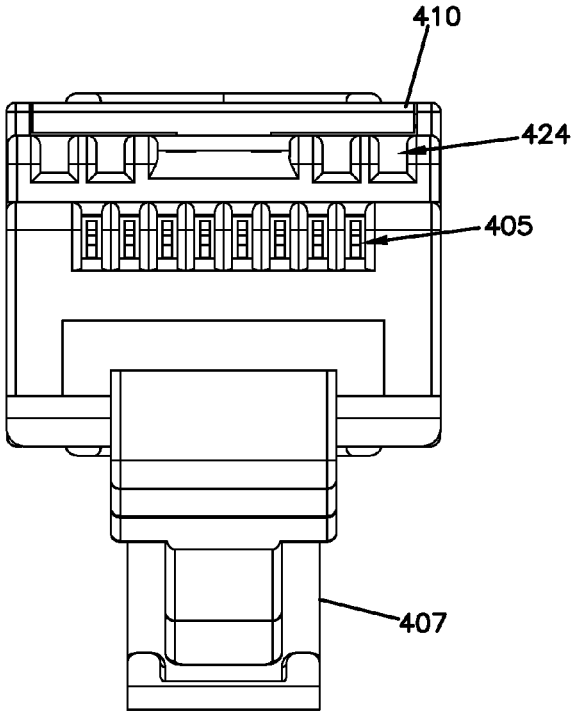
FIG. 8 is a front view of the example plug connector of FIG. 4 in accordance with aspects of the present disclosure.
Figure 9:
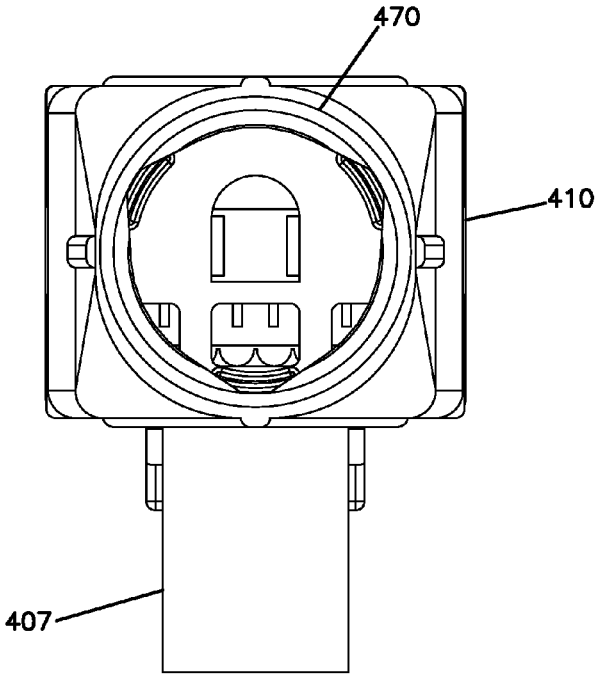
FIG. 9 is a rear view of the example plug connector of FIG. 4 in accordance with aspects of the present disclosure.

The plug nose 410 includes a body 411 that has a first side 404 and a second side 406 (see FIG. 5). A finger tab 407 extends from the first side 404 of the plug nose body 411. In the example shown, the finger tab 407 extends from the first side 404 of the plug 402 at the front of the plug nose body 411. The finger tab 407 facilitates latching the plug 402 within the socket of the jack module or other connector assembly (e.g., connector assembly 320 of FIG. 3). In one implementation, the finger tab 407 extends outwardly from a keying portion 413 that aids in aligning the plug 402 with a port 325 of the connector assembly 320.

The second side 406 of the plug nose 410 is configured to hold main signal contacts 405, which are electrically connected to the twisted pair conductors of the telecommunications cable 480. The main signal contacts 405 are configured to electrically connect to contacts positioned in the jack module, such as to contacts 322 of FIG. 3, for signal transmission (e.g., of primary signals S1 of FIG. 1). The plug nose body 411 also includes ribs 412 covering the main signal contacts 405 to protect the contacts. In the example shown, the main signal contacts 405 and ribs 412 are positioned at a front of the plug nose body 411 on the second side 406 of the plug 402.

The connector arrangement 400 also includes a storage component 420 (FIG. 10) that is configured to store information (e.g., media information) pertaining to the segment of physical communications media (e.g., the plug 402 and/or the electrical cable 480 terminated thereby). In the example shown, the storage component 420 is mounted to a surface 414 on the second side 406 of the plug nose body 411. Secondary contacts 424 of the storage component 420 are moveably mounted to the plug nose body 411. For example, in certain implementations, the secondary contacts 424 can move relative to the plug nose body 411 between at least an extended position and a retracted position.

FIGS. 55-58 show how movement of the storage component 420 can aid in fitting the connector arrangement 400 into various sockets. For ease in viewing, the connector arrangement 400 and sockets are shown schematically. The primary contacts 405 terminating the cable 480, the storage component 420, and secondary contacts 424 also are visible on the connector arrangement 400.

Figure 55:
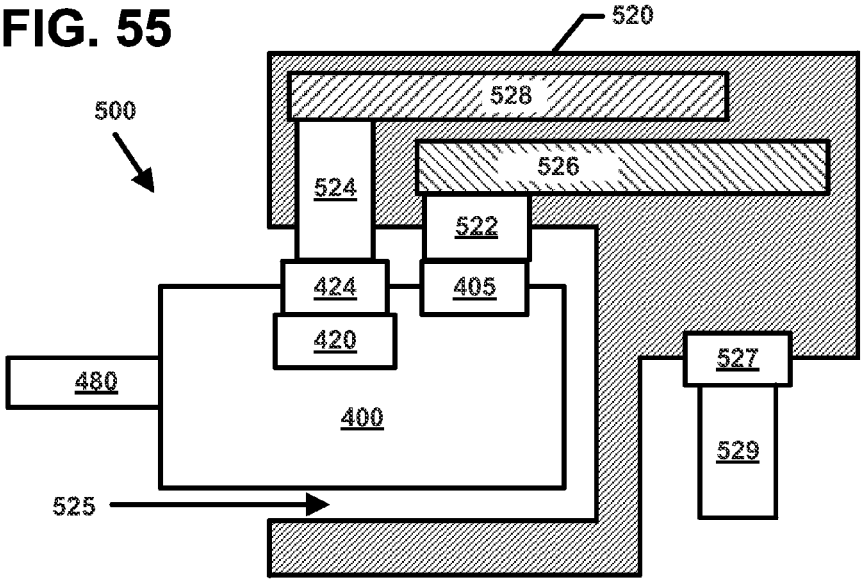
FIGS. 55 and 56 show the connector arrangement of FIGS. 4-11 inserted within a first example socket including primary contacts and a media reading interface in accordance with aspects of the present disclosure.
Figure 56:
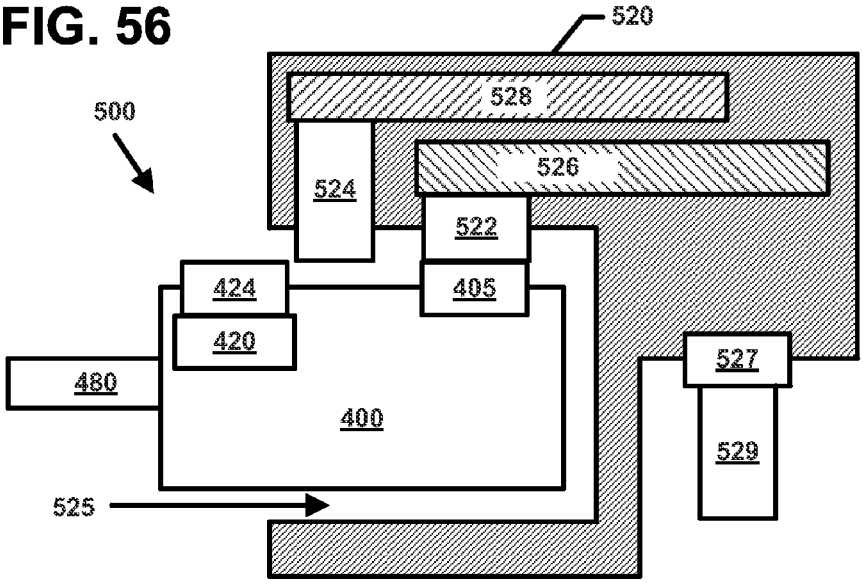

FIGS. 55 and 56 show the connector arrangement 400 inserted within a first example socket 500. The socket 500 defines a cavity 525 into which the plug 402 of the connector arrangement 400 is inserted. The socket 500 also includes a first set of contacts 522 electrically connected to a plurality of wire cores of cable 529 terminated at contacts (e.g., insulation-displacement contacts) 527. For example, the first set of contacts 522 may connect to the insulation-displacement contacts 527 via a printed circuit board 526. The first set of contacts 522 are configured to engage the primary contacts 405 of the connector arrangement 400 when the connector arrangement 400 is inserted into the socket cavity 525.

The socket 500 also includes a media reading interface (e.g., a set of contacts) 524 that is configured to electrically connect to a processor, memory, or PLI data network. For example, the media reading interface 524 may be connected to a second printed circuit board 528. The media reading interface 524 is configured to engage the secondary contacts 424 of the connector arrangement 400 when the secondary contacts 424 are in the extended position (see FIG. 55). Accordingly, PLI data stored on the memory component 420 may be passed to the printed circuit board 528 or to a PLI network via the secondary contacts 424, 524. The media reading interface 524 does not engage the secondary plug contacts 424 when the secondary plug contacts 424 are in the retracted position (see FIG. 56). Accordingly, PLI data stored on the memory component 420 is not provided to the printed circuit board 528 or other data network.

Figure 57:
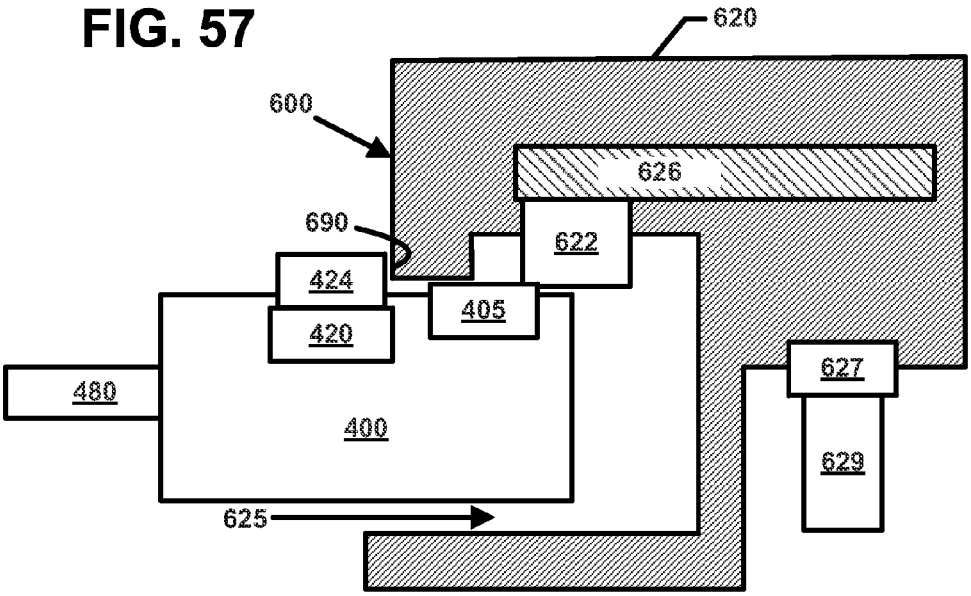
FIGS. 57 and 58 show the connector arrangement of FIGS. 4-11 inserted within a second example socket including primary contacts, and not including a media reading interface, in accordance with aspects of the present disclosure.
Figure 58:
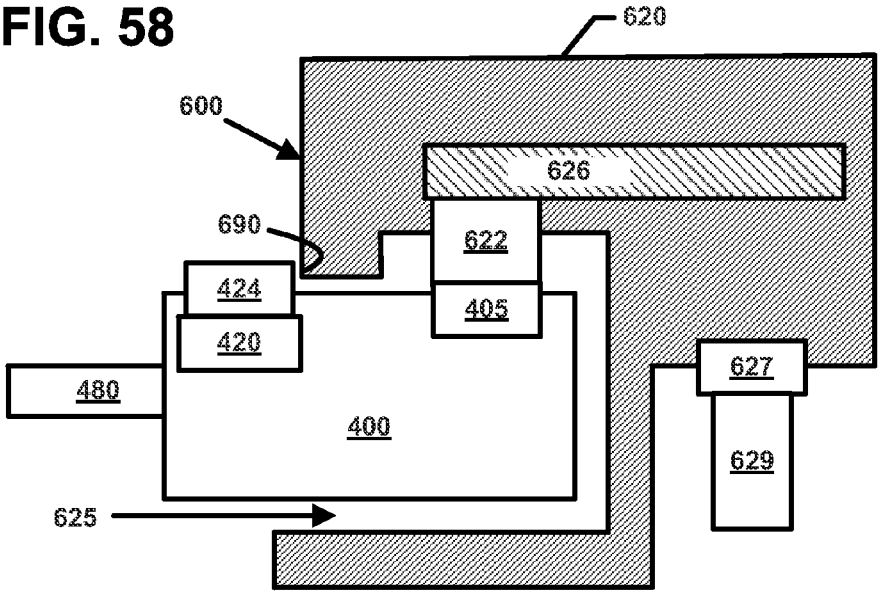

FIGS. 57 and 58 show the connector arrangement 400 inserted within a second example socket 600. The example socket 600 defines a cavity 625 into which the plug 402 of the connector arrangement 400 is inserted. The socket 600 also includes a first set of contacts 622 electrically connected to a plurality of wire cores of cable 629 terminated at contacts (e.g., insulation-displacement contacts) 627. For example, the first set of contacts 622 may connect to the insulation-displacement contacts 627 via a printed circuit board 626. The first set of contacts 622 are configured to engage the primary contacts 405 of the connector arrangement 400 when the connector arrangement 400 is inserted into the socket cavity 625.

The socket 600 does not include a media reading interface configured to engage the secondary contacts 424 of the connector arrangement 400. Accordingly, PLI data stored on the memory component 420 is not provided to the PLI data network. Rather, the socket 600 defines an entrance 690 to the port 625 that is sized and shaped to enable the primary contacts 405, but not the secondary contacts 424, to pass through the entrance 690 (see FIG. 57). In some implementations, the secondary contacts 424 abut the entrance 690 before the primary contacts 405 can make contact with the first set of contacts 522. Accordingly, the secondary contacts 424 inhibit insertion of the connector arrangement 400 into the socket 500.

As shown in FIG. 58, the secondary contacts 424 may be moved to the refracted position to insert the connector arrangement 400 within the socket cavity 625. Moving the secondary contacts 424 to the retracted position enables the primary contacts 405 to be fully inserted into the socket before the secondary contacts 424 abut the socket entrance 690. In some implementations, only the secondary contacts move between extended and retracted positions. In other implementations, however, the storage component 420 moves along with the contacts 424.

In certain implementations, the secondary contacts 424 are carried on the storage component 420. In some implementations, the plug nose body 411 defines a partial enclosure for the storage component 420 and contacts 424. In other implementations, however, the plug nose body 411 cooperates with a cover 430 (e.g., see FIGS. 21-29) to define the partial enclosure (see FIG. 10). For example, in certain implementations, the plug nose body 411 defines a rear wall 415 and side walls 416 that protrude upwardly from a rear of the surface 414. The cover 430 can include latching members 432 that are configured to be received within openings 417 (FIG. 10) that are defined in the plug nose body 411 to define the partial enclosure.

Figure 28:
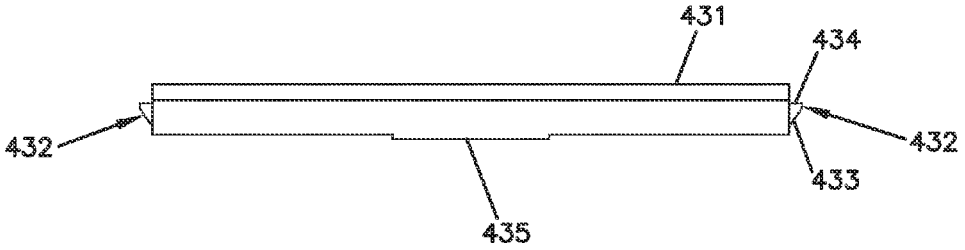
Figure 29:
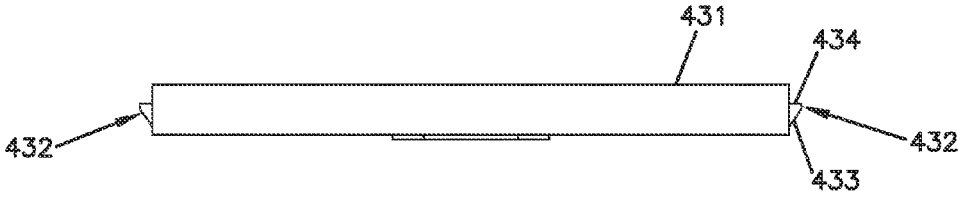
Figure 30:
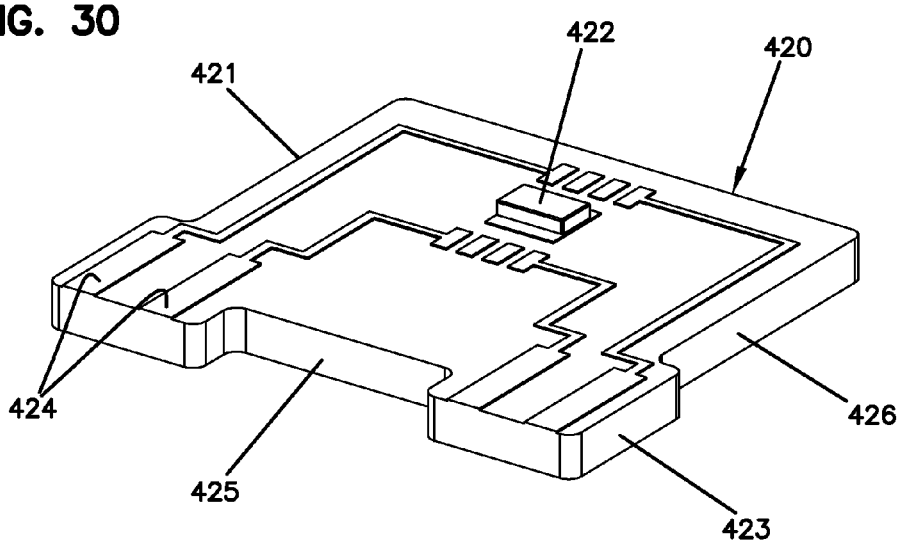
FIGS. 30-38 illustrate various views of the example storage component and secondary contact arrangement shown in FIG. 4 in accordance with aspects of the present disclosure.
Figure 31:
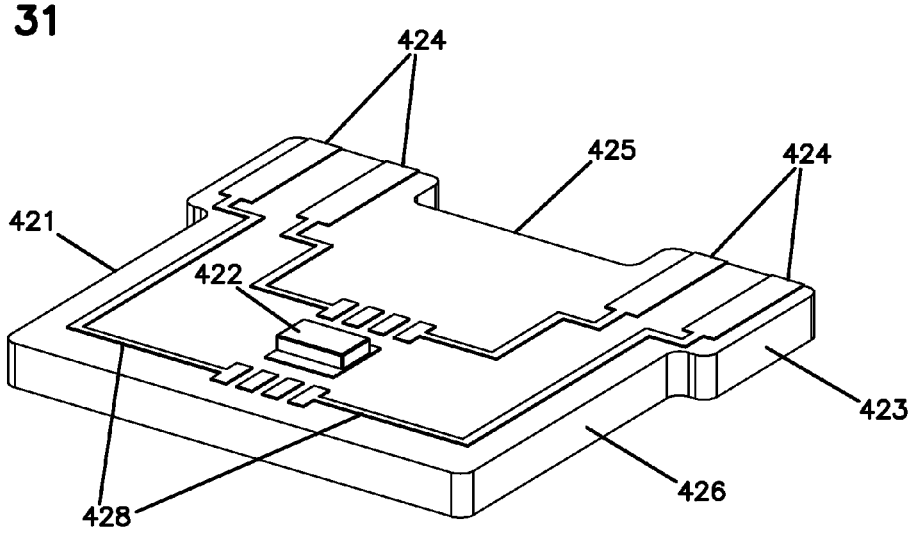
Figure 32:
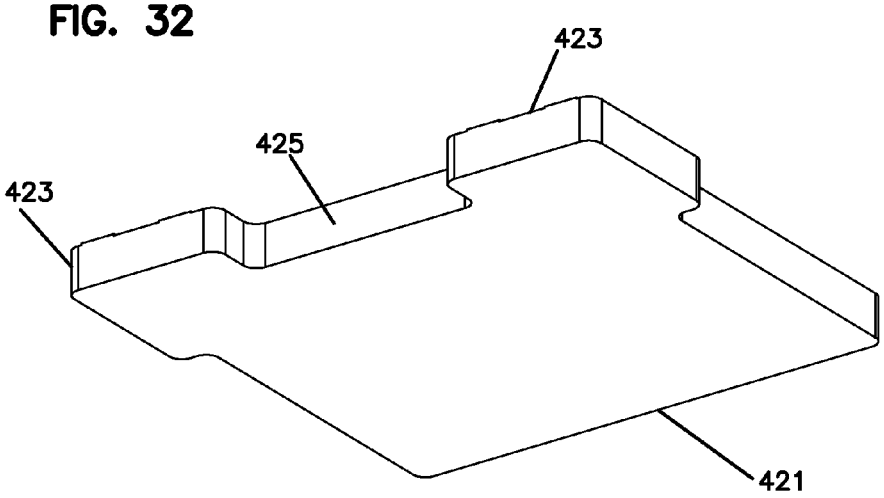
Figure 33:
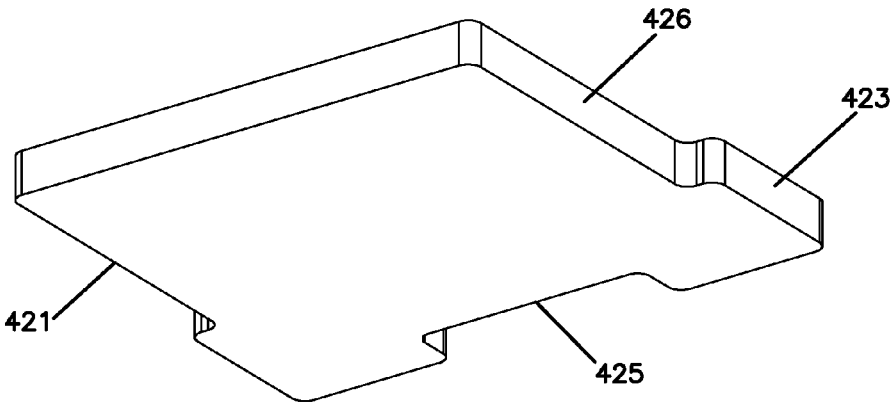
Figure 34:
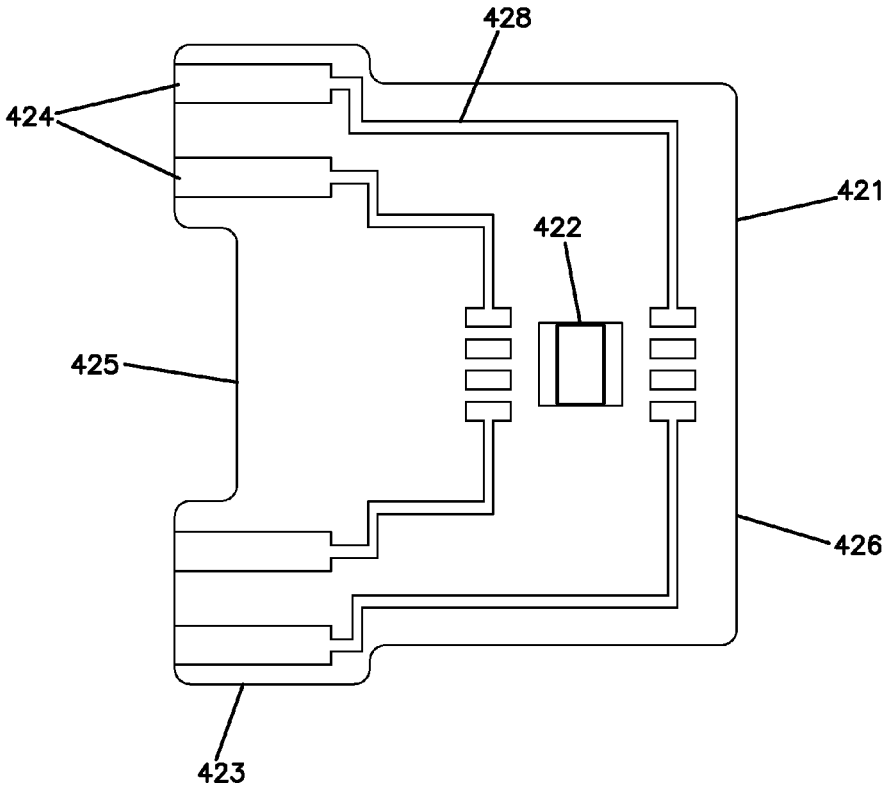
Figure 35:
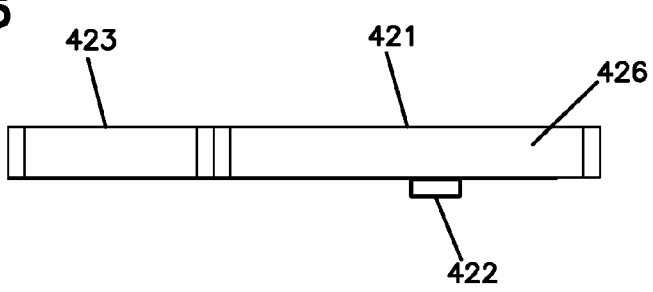
Figure 36:
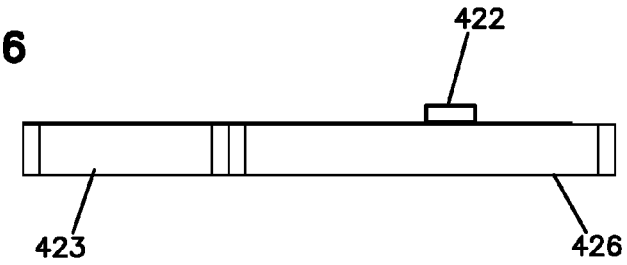
Figure 37:
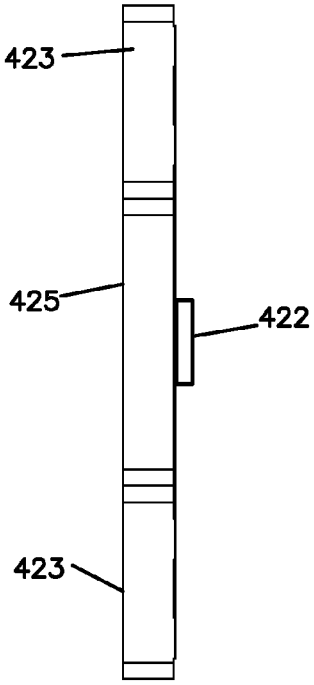
Figure 38:
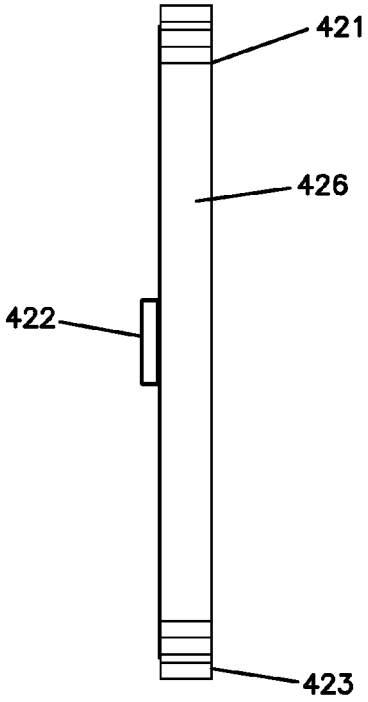

As shown in FIGS. 21-29, in some example implementations of the cover 430, the cover member 430 has a body 431 including the latching members 432. In certain implementations, the latching members 432 protrude from opposite sides of a cover member body 431. In one implementation, the latching members 432 cooperate with openings 417 defined in the side walls 416 of the plug nose body 411. In one implementation, each latching member 432 includes a cam surface 433 and a shoulder 434 (FIGS. 28 and 29). The cam surface 433 of each latching members 432 facilitates insertion of the latching members 432 into the openings 417 defined in the side walls 416. The shoulders 434 snap into place within the openings 417 to secure the cover 430 to the plug nose body 411 to define the partial enclosure.

The cover member body 431 also defines a through-opening 436 passing between a top and bottom of the cover member body 431. A bottom surface of the body 431 defines a channel 437 extending generally between a front and back of the cover member body 431 (see FIGS. 23 and 24). In the example shown, the through-opening 436 extends through the channel 437 (see FIG. 26). The cover member body 411 also includes a key member 435 at a front end of the channel 437 (see FIGS. 26 and 28). In the example shown, the key member 435 defines a generally U-shaped extension from the bottom of the cover member body 411. The key member 435 is configured to interact with the contact shroud 440 as described herein.

The storage component 420 mounts within the partial enclosure defined by the plug nose body 411 and the cover member body 431 (e.g., see FIG. 10). In one implementation, shown in FIGS. 30-38, the media storage component 420 includes an EEPROM 422 mounted to a printed circuit board 426. In other implementations, however, the storage component 420 can include any suitable type of memory. Secondary contacts (e.g., circuit contacts) 424 of the storage component 420 permit connection of the EEPROM 422 to a media reading interface, such as media reading interface 324 of the connector assembly 320 of FIG. 3. Conductive tracings 428 connect the EEPROM 422 to the secondary contacts 424.

In the example shown, the printed circuit board 426 includes a main portion 421 on which the memory (e.g., an EEPROM) 422 is mounted. The printed circuit board 426 also includes feet 423 at opposite sides of one end of the main portion 421. A dip or recess 425 extends between the feet 423. The secondary contacts 424 are provided on the feet 423 of the printed circuit board 426. In the example shown, two secondary contacts 424 are provided on each foot 423. In other implementations, however, greater or fewer secondary contacts 424 can be provided on greater or fewer feet 423.

A contact shroud 440 also mounts within the partial enclosure to cover the storage component 420. In accordance with some aspects, the shroud 440 is configured to enable movement of the secondary contacts 424 relative to the plug nose 410. In some implementations, the secondary contacts 424 move independently of the storage component 420. In other implementations, however, the secondary contacts 424 move together with the storage component 420 relative to the plug nose 410.

Figure 11:
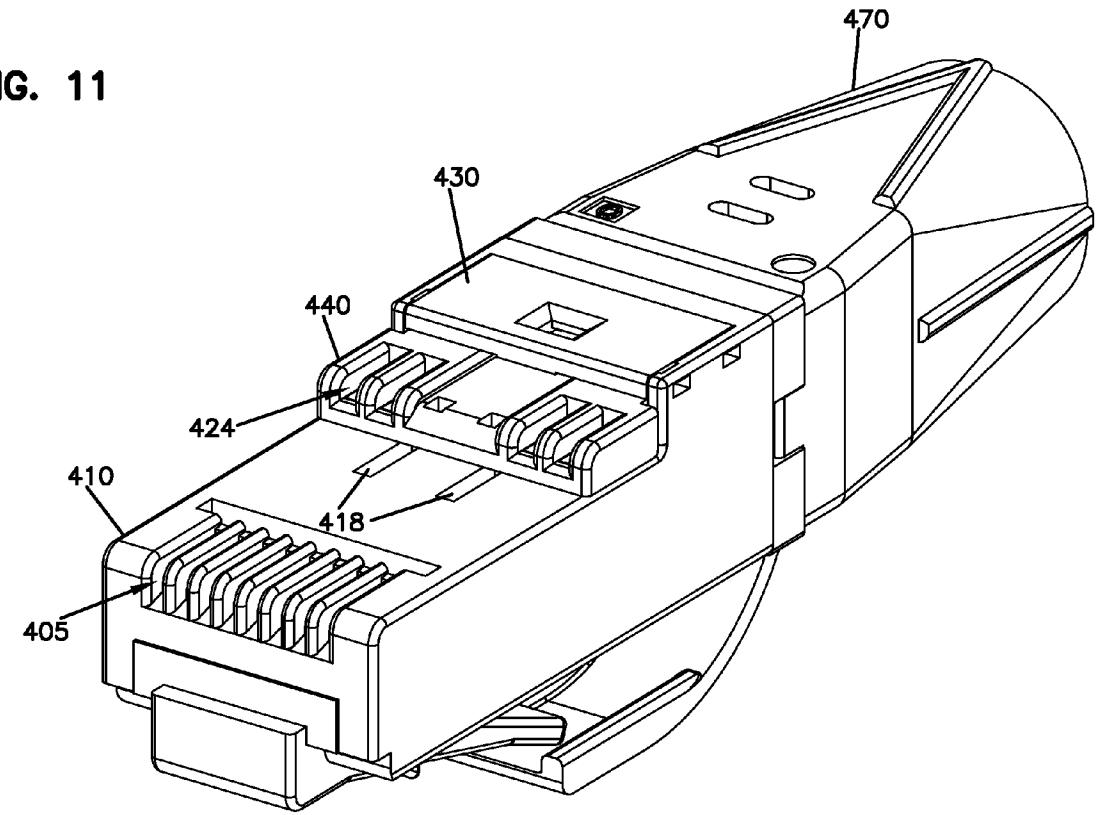
FIG. 11 is a top, front perspective view of the example plug connector including a storage component and secondary contacts in a rearward position in accordance with aspects of the present disclosure.
Figure 12:
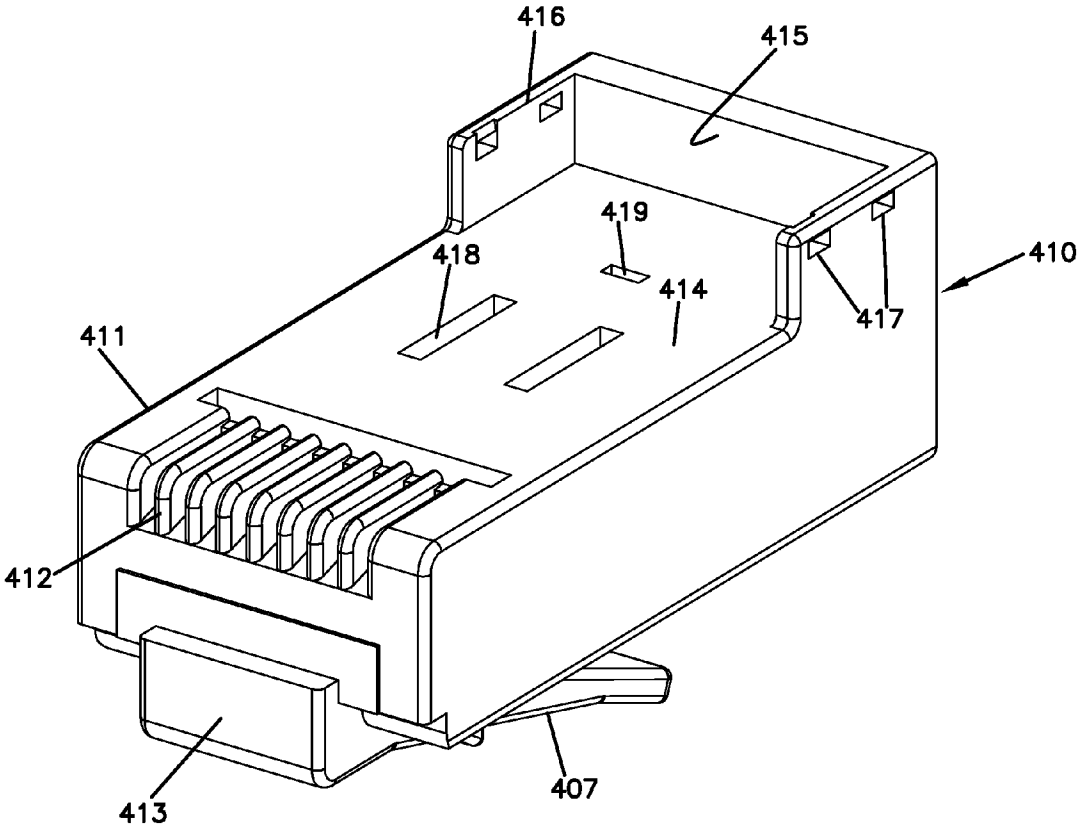
FIGS. 12-20 illustrate various views of the example plug nose body shown in FIG. 4 in accordance with aspects of the present disclosure.
Figure 13:
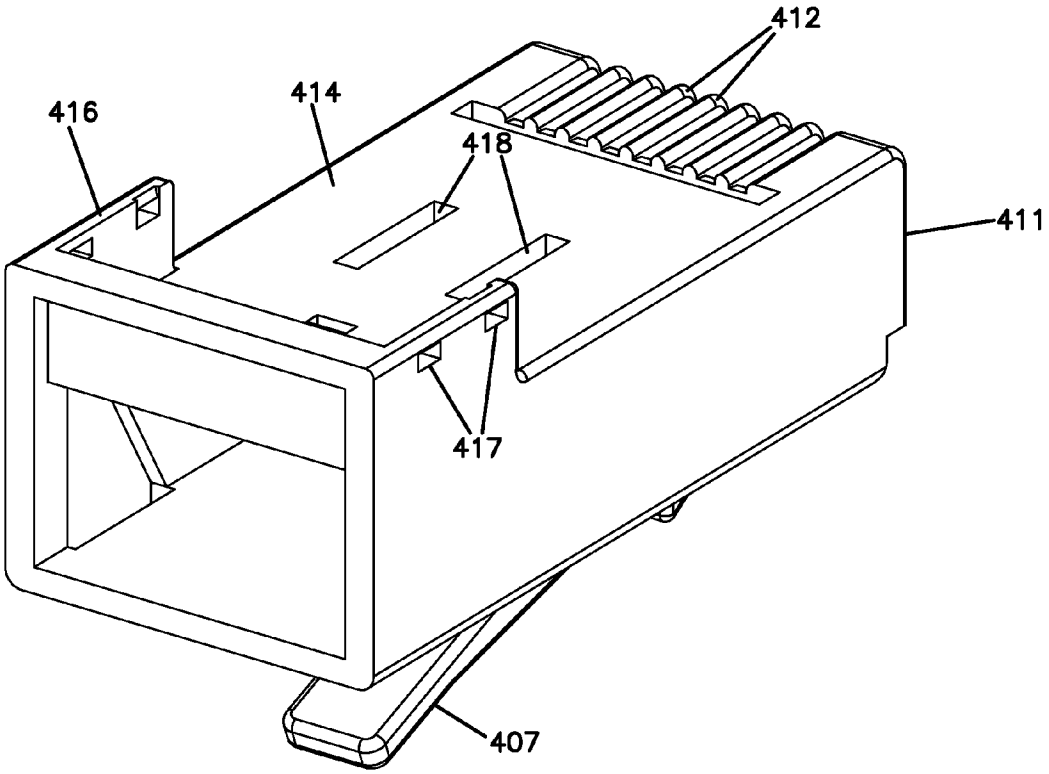
Figure 14:
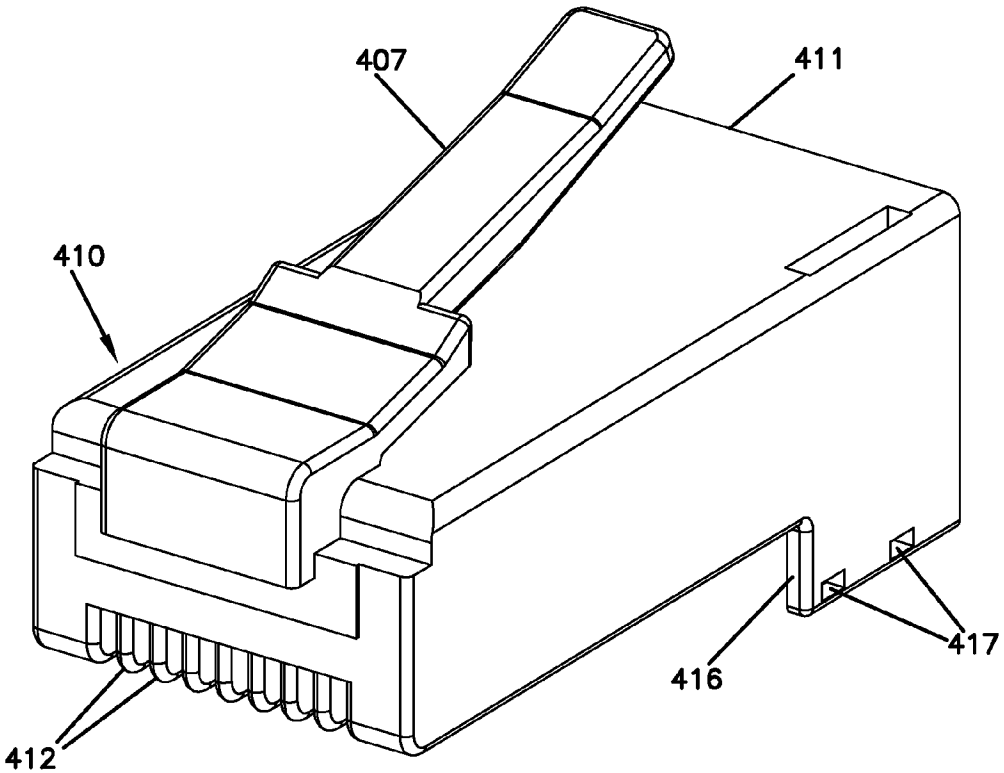
Figure 15:
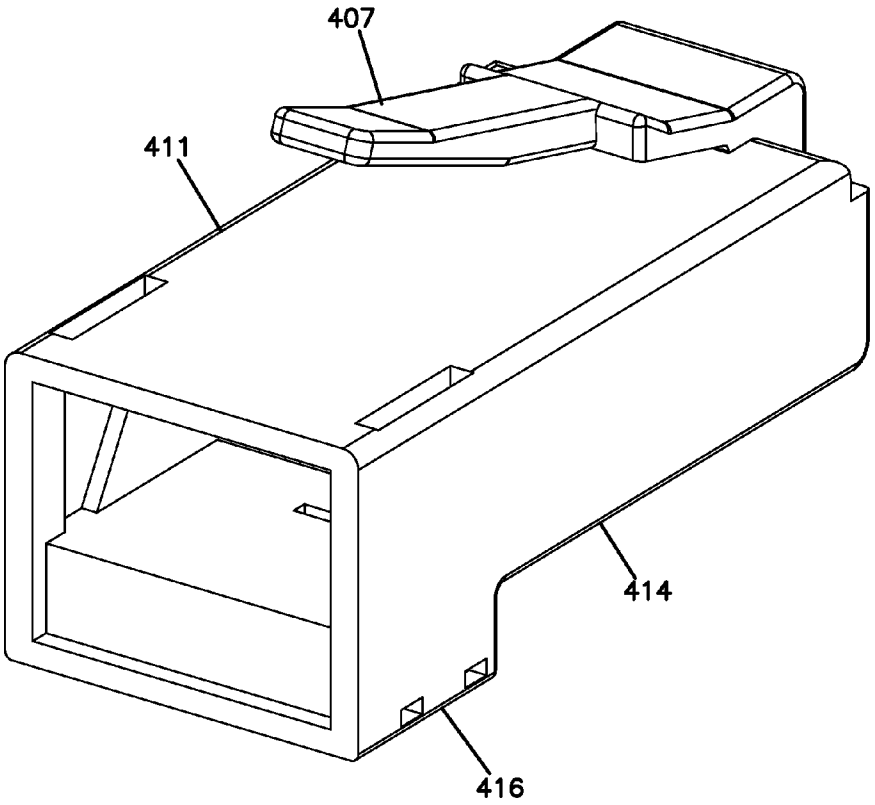
Figure 16:
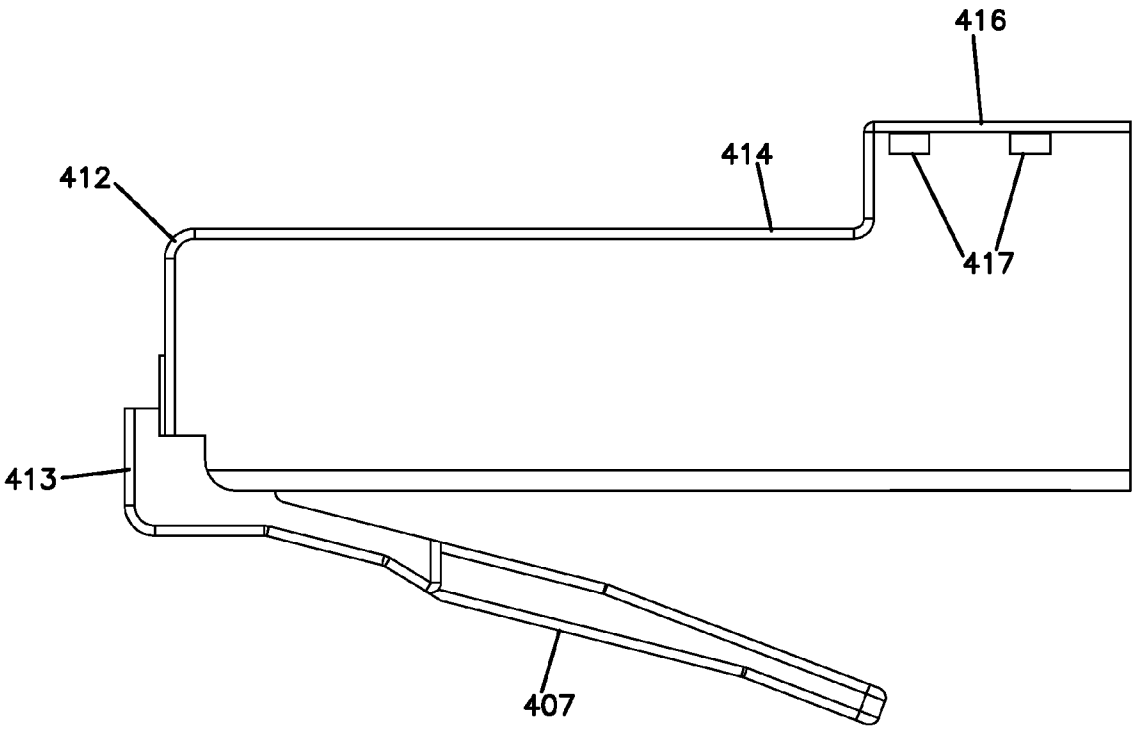
Figure 17:
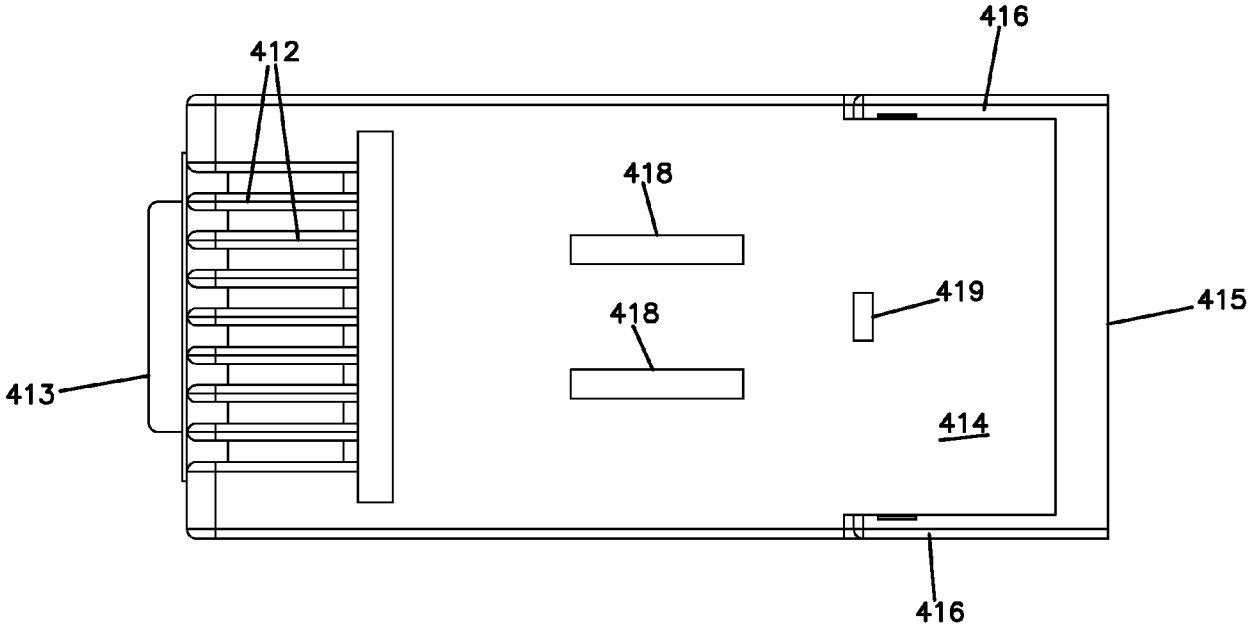
Figure 18:
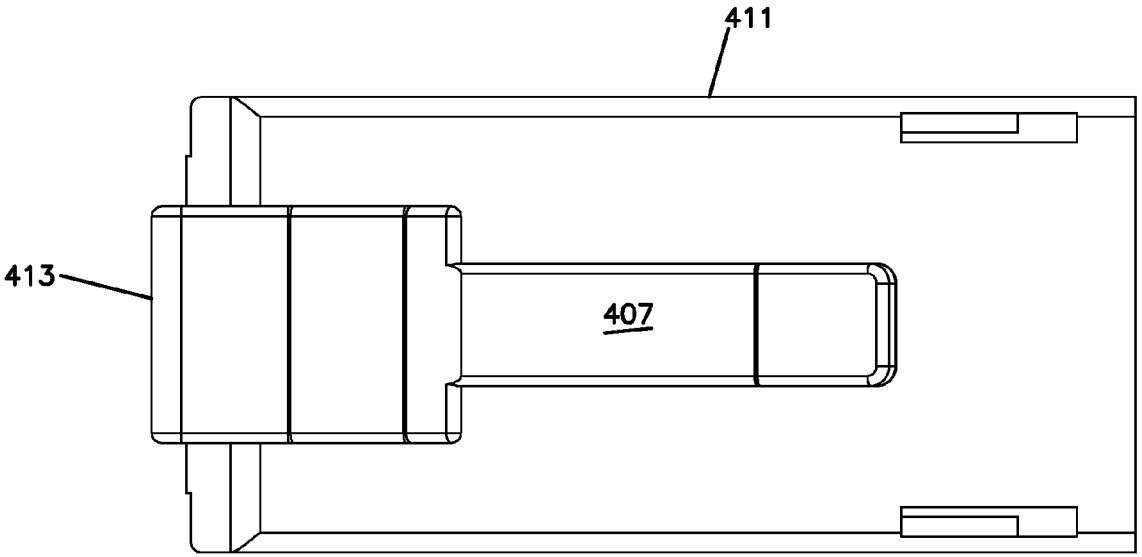
Figure 19:
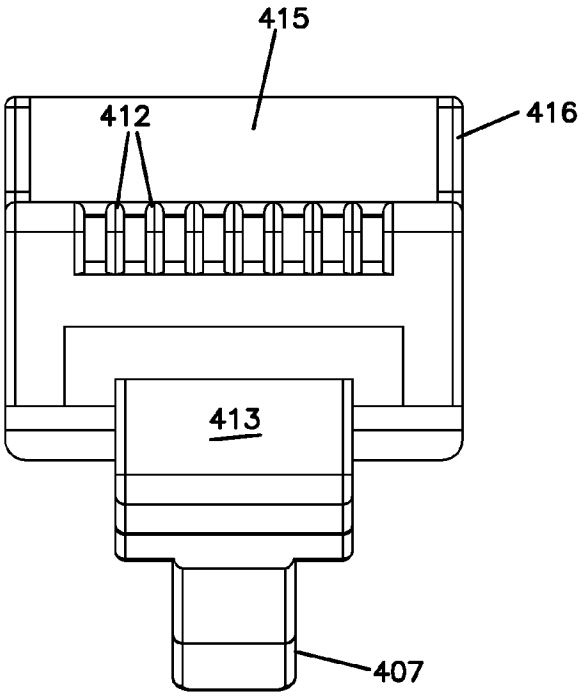
Figure 20:
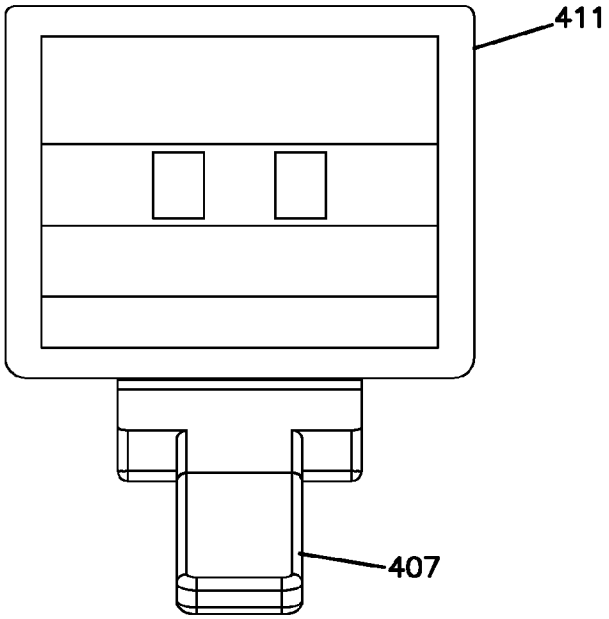
Figure 21:
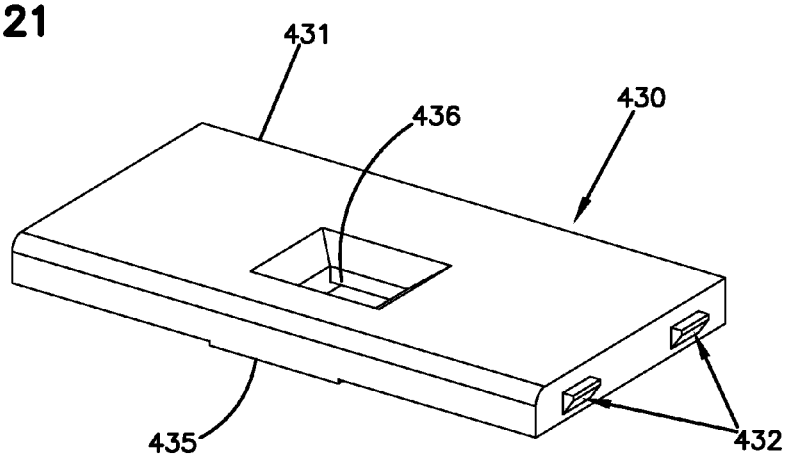
FIGS. 21-29 illustrate various views of the example cover shown in FIG. 4 in accordance with aspects of the present disclosure.
Figure 22:
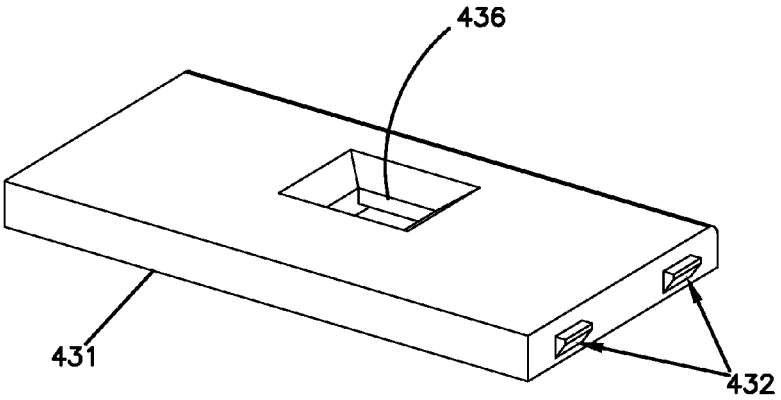
Figure 23:
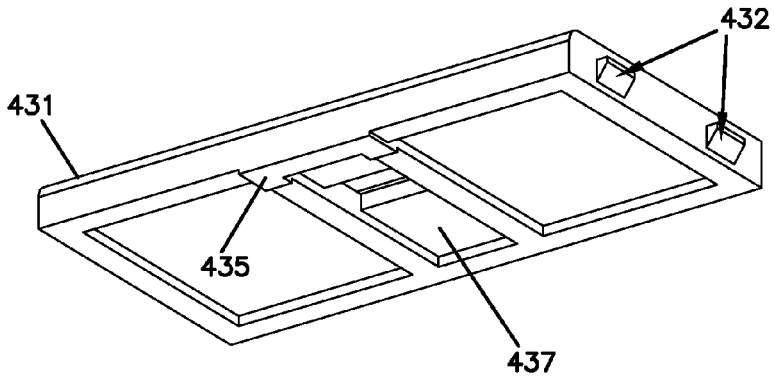
Figure 24:
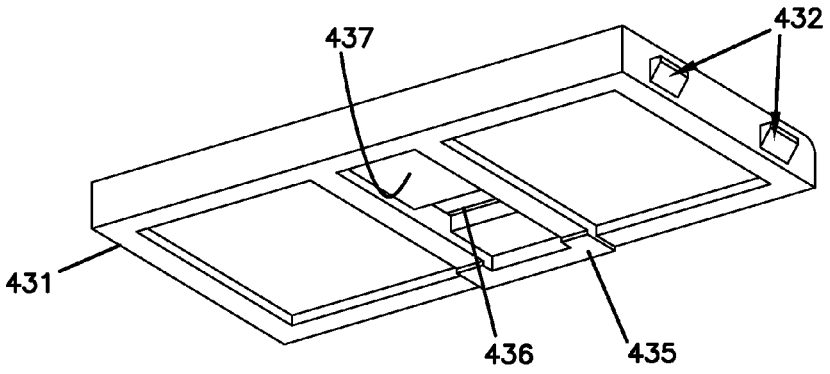
Figure 26:
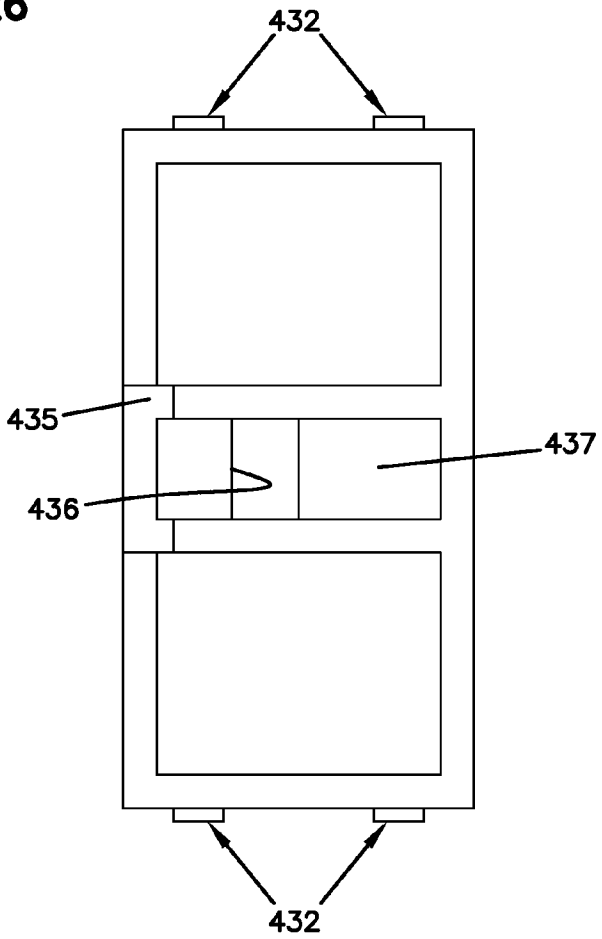
Figure 25:
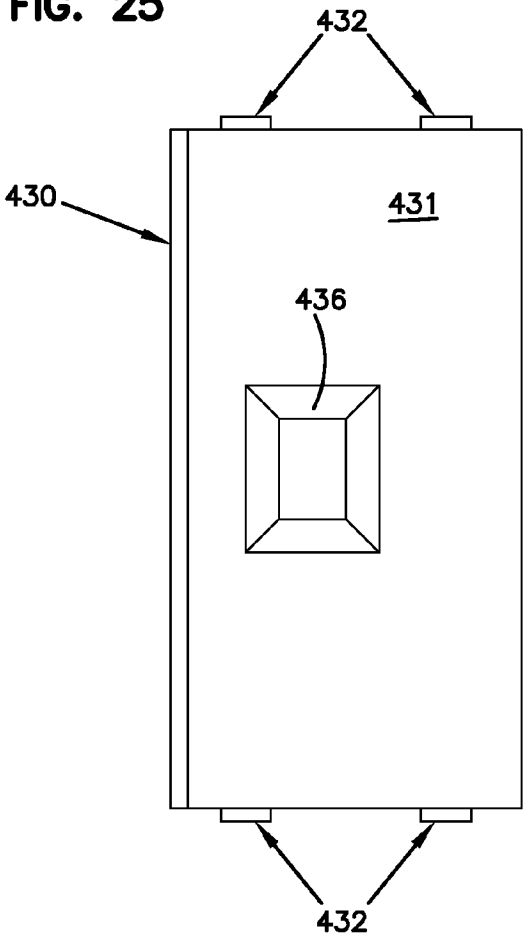
Figure 27:
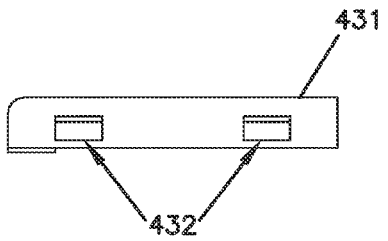

In some implementations, the secondary contacts 424 and contact shroud 440 can be mounted to slide along the surface 414 of the plug nose body 411 when a force is applied to the shroud 440. In one implementation, the secondary contacts 424 and contact shroud 440 slides between extended and retracted positions relative to the plug nose body 411. FIG. 4 shows one example plug arrangement 400 with the contact shroud 440 and secondary contacts 440 in an extended position. FIG. 11 shows the example plug arrangement 400 with the contact shroud 440 and secondary contacts in a retracted position.

In accordance with some aspects, moving the secondary contacts 424 into the extended position enables the secondary contacts 424 to make contact with a media reading interface of a connector assembly when the plug 402 is inserted into a socket port of the connector assembly. Accordingly, primary communication signals S1 can be conveyed through the main signal contacts 405 and secondary communication signals S2 can be conveyed through the secondary contacts 424. Moving the secondary contacts 424 into the retracted position spaces the secondary contacts 424 from the media reading interface of the connector assembly when the plug 402 is inserted, thereby inhibiting interaction between the secondary contacts 424 and the media reading interface. Accordingly, only primary signals S1 are conveyed when the plug 402 is inserted into the socket port.

For example, in one implementation, inserting the plug 402 into the connector assembly 520 of FIG. 55 when the contacts 424 are in the extended position may align the contacts 424 with the media reading interface 524 of the connector assembly 520 to enable communication therebetween. However, inserting the plug 402 into the connector assembly 520 when the contacts 424 are in the retracted position may position the contacts 424 at a location spaced from the media reading interface 524 of the connector assembly 520 (e.g., see FIG. 56).

In certain implementations, the secondary contacts 424 may remain at least partially outside the socket port of the connector assembly when the contacts are in the retracted position and the plug 402 is inserted. In one implementation, the secondary contacts 424 may not enter the socket port at all when the plug 402 is inserted into the socket port with the secondary contacts 424 in the retracted position.

Figure 44:
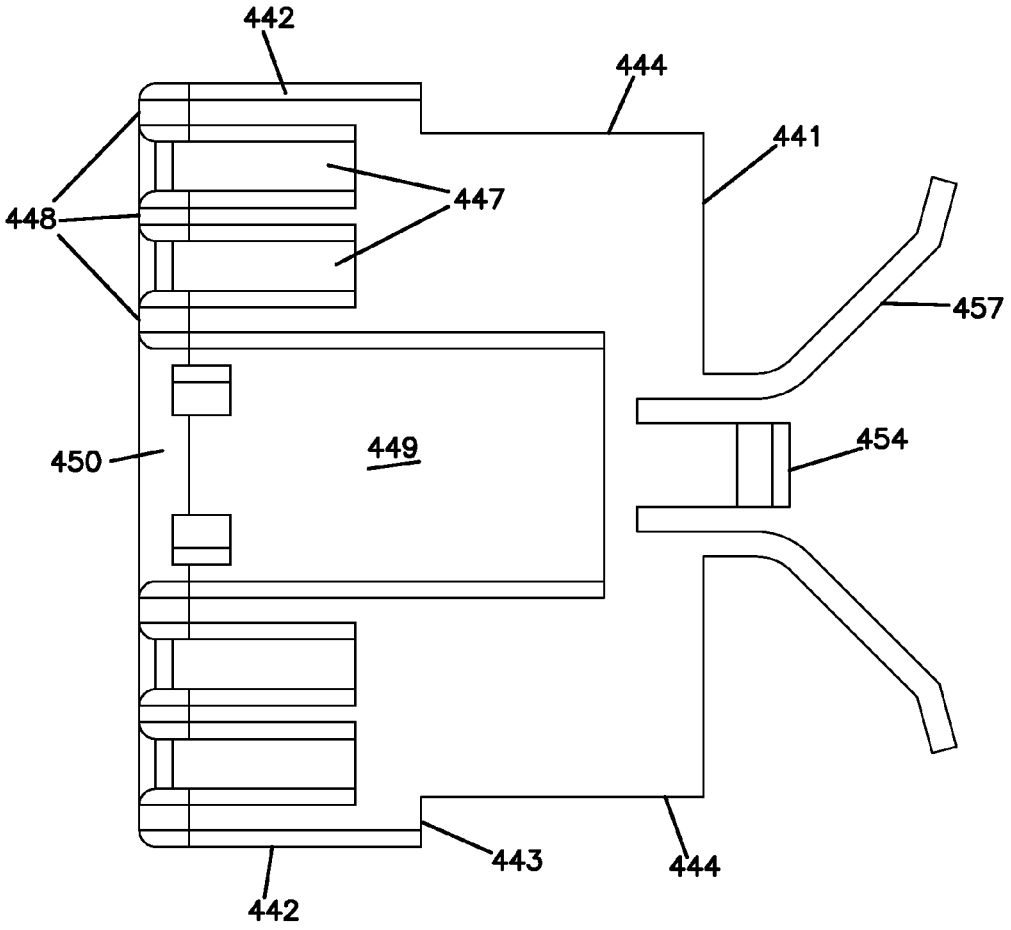
Figure 45:
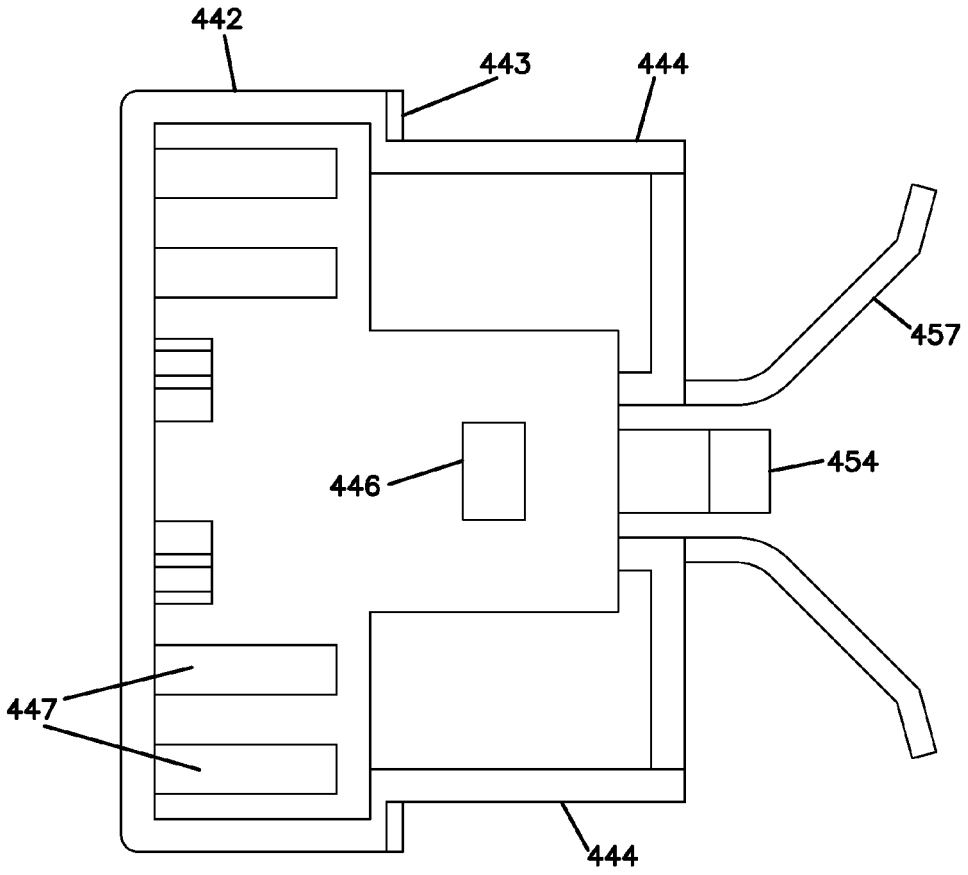
Figure 48:
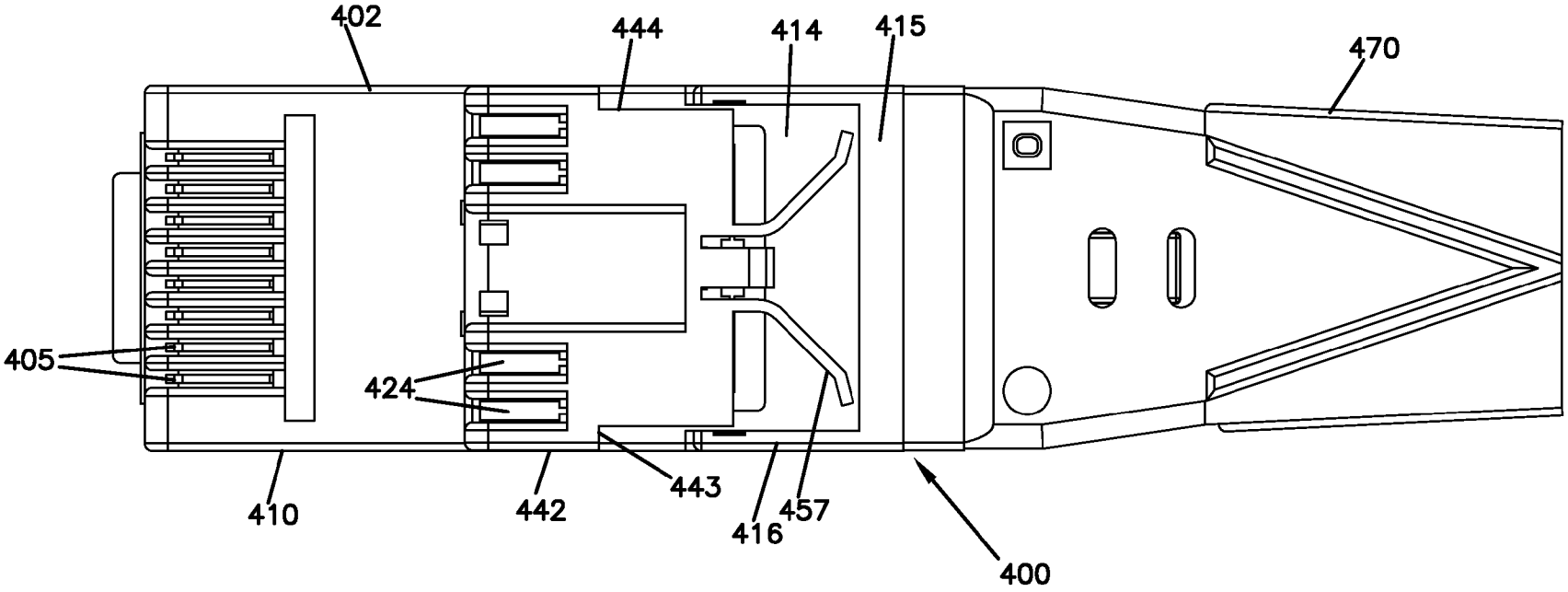
FIG. 48 is a top plan view with portions removed of the example plug connector of FIG. 4 with an example shroud in a forward position in accordance with aspects of the present disclosure.
Figure 49:
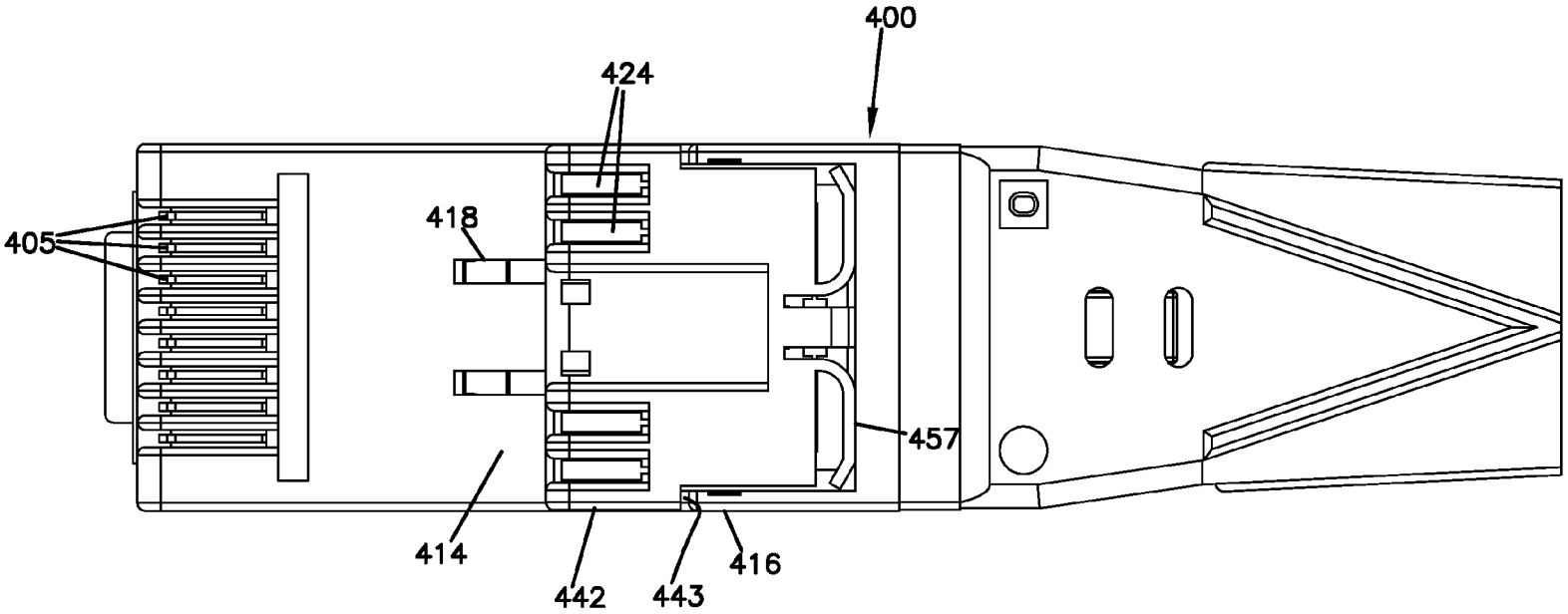
FIG. 49 is a top plan view with portions removed of the example plug connector of FIG. 4 with the example shroud in a rearward position in accordance with aspects of the present disclosure.

One example implementation of a contact shroud 440 is shown in FIGS. 39-47. The example contact shroud 440 includes a shroud body 441 having a forward portion 442 and a rearward portion 444. The rearward portion 444 steps inwardly from the forward portion 442 to define rearward-facing shoulders 443 (FIG. 44). The rearward portion 444 is configured to fit at least partially within the pocket defined by the plug nose 410 and cover 430 (see FIGS. 4 and 11). The forward portion 442 of the shroud 440 is positioned forwardly of the cover 430. The shoulders 443 face the edges of the sidewalls 416 (see FIGS. 4 and 11). In the implementation shown in FIG. 11, the shoulders 443 of the shroud 440 abut against the side edges of walls 416 when the shroud 440 is in the second position.

The contract shroud 440 mounts over the storage component 420 within the plug nose pocket. The shroud body 441 includes sidewalls extending downwardly from an upper end to defines a pocket 445 in which the storage component 420 can be retained (see FIG. 42). In one implementation, the shroud body 441 holds the storage device 420 at a fixed position within the pocket 445. In one implementation, the upper end defines a cavity 446 (FIG. 45) sized to accommodate the circuitry (e.g., the EEPROM chip) of the storage component 420 when the storage component is positioned within the shroud pocket 445.

A front portion of the shroud body 441 defines slots 447 that provide access to the secondary contacts 424 when the storage component 420 is positioned within the shroud pocket 445. For example, in certain implementations, the slots 447 align with the contact pads 424 arranged on the printed circuit board 426 of the storage component 420. The shroud body 441 also includes ribs 448 that protect the contact pads 424 of the storage component 420. In the example shown, a first section of slots 447 and ribs 448 is spaced from a second section of slots 447 and ribs 448. In other implementations, however, the slots 447 and ribs 448 can extend across the entire front of the shroud 440 or any portion thereof.

Referring to FIGS. 10 and 11, the shroud 440 may be guided along the plug body 411 when moving between the extended and retracted positions. For example, the shroud body 441 may include one or more guide members 451 that extend downwardly from the shroud body 441. The guide members 451 are sized and configured to interact with slots 418 provided in the surface 414 of the plug nose body 411 (see FIG. 10). In the example shown in FIGS. 41 and 42, the guide members 451 include resilient arms 452 having distal ends defining latching members 453. The arms 452 can be flexed laterally toward the sides of the shroud body 441. The latching members 453 cam into the slots 418 and catch against an inner surface of the plug nose body 411. Accordingly, the shroud body 441 can be moved (e.g., slid) along the length of the slots 418 (e.g., compare FIGS. 4 and 11).

In some implementations, the shroud body 441 also defines an upper channel 449 and ramped forward surface 450. For example, in one implementation, the shroud body 441 defines the upper channel 449 and the ramped forward surface 450 between the sets of slots 447 and ribs 448 The key member 435 of the cover 430 rides in the channel 449 of the shroud 440 when the shroud 440 is slid between positions (e.g., compare FIGS. 4 and 11). In accordance with one aspect, the key member 435 facilitates sliding the shroud 440 and storage component 420 in a linear fashion. In accordance with another aspect, the key member 435 inhibits removal of the shroud 440 and storage component 420 from the plug nose 410.

In some implementations, the shroud 440 includes a biasing member 457. For example, in certain implementations, the shroud 440 includes at least a resilient leg 457 configured to bias the shroud body 441 into position relative to the plug nose body 411. In the example shown in FIGS. 39-47, the shroud body 441 includes two resilient legs 457 protruding from the rearward portion 444 of the shroud body 441. The legs 457 are configured to mount within the partial enclosure defined by the cover 430 and the plug body 411. The legs 457 can be compressed against the wall 415 of the plug nose body 411 when the shroud 440 and storage component 420 are in the retracted position within the partial enclosure (see FIG. 49). In certain implementations, the legs 457 are configured to press against the wall 415 of the plug nose body 411 to bias the shroud 440 to the forward position. In some implementations, the legs 457 are fully relaxed and do not abut the rear wall 415 when the shroud 440 and storage component 420 are in the extended position (see FIG. 48).

In some implementations, the shroud 440 and secondary contacts 424 can be secured into one of the positions relative to the plug nose body 411 (e.g., against the bias of the legs 457). For example, in one implementation, the shroud 440 and the secondary contacts 424 can be secured in the extended position (e.g., see FIG. 48). In another implementation, the shroud 440 and the secondary contacts 424 can be secured in the retracted position (e.g., see FIG. 49). In still other implementations, the shroud 440 and the secondary contacts 424 can be selectively secured into either position. In still other implementations, the shroud 440 and secondary contacts 424 can be manually retracted and manually retained against the bias of the legs 457 during insertion.

Figure 39:
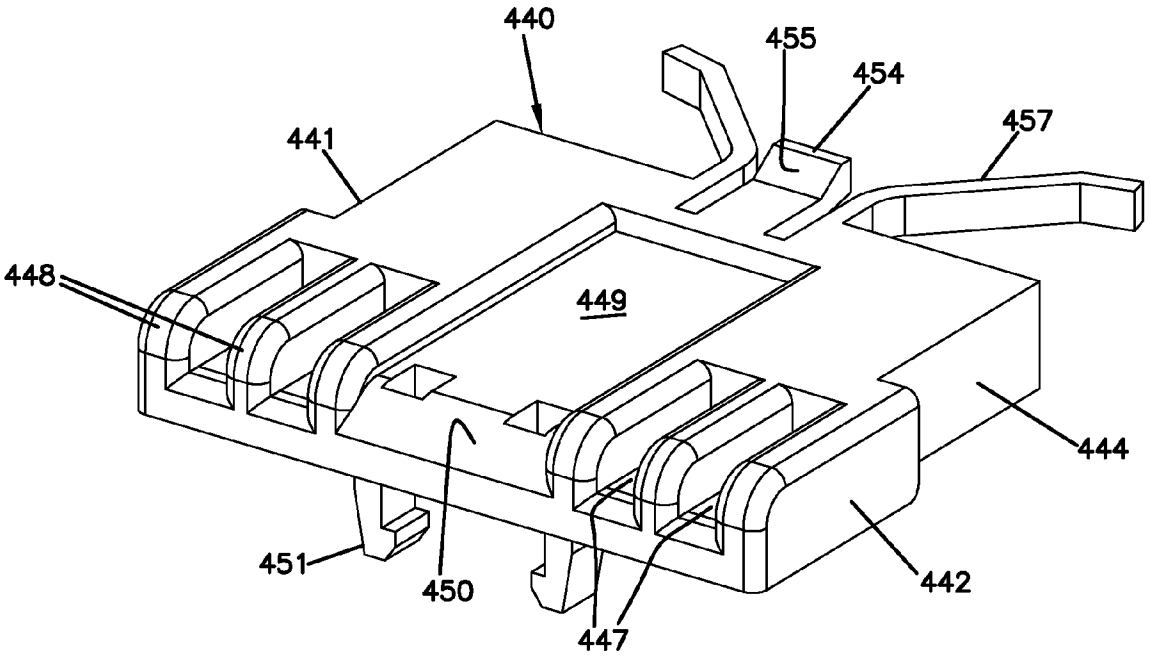
FIGS. 39-47 illustrate various views of the example shroud shown in FIG. 4 in accordance with aspects of the present disclosure.
Figure 40:
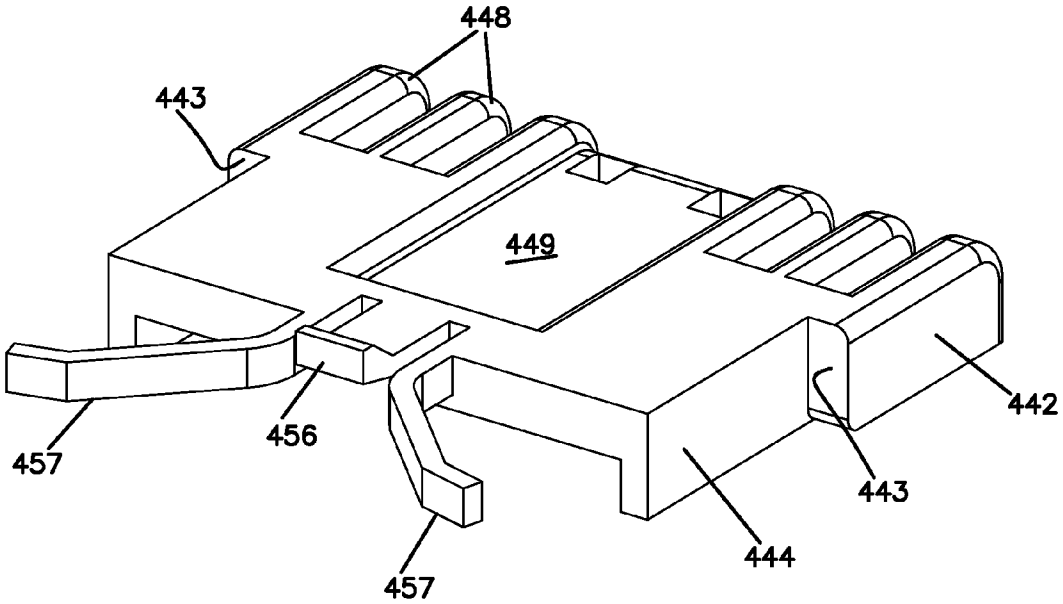
Figure 41:
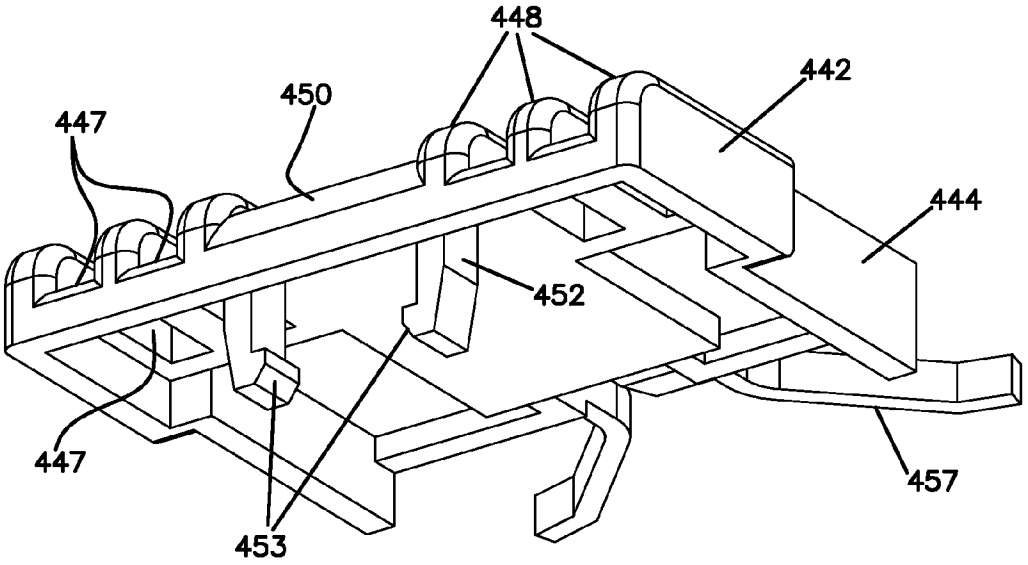
Figure 42:
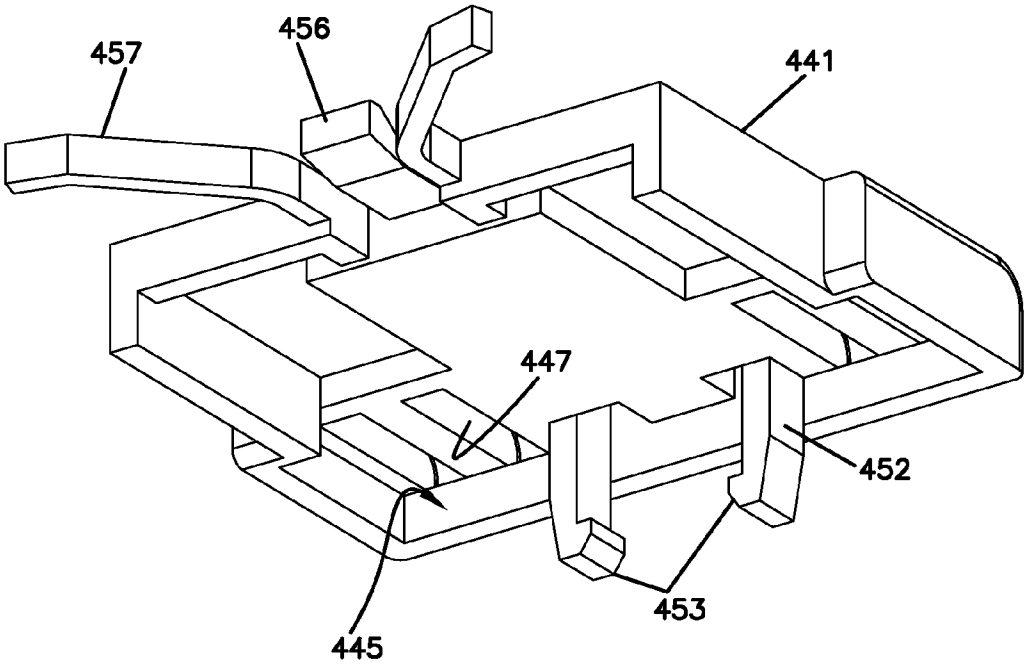
Figure 43:
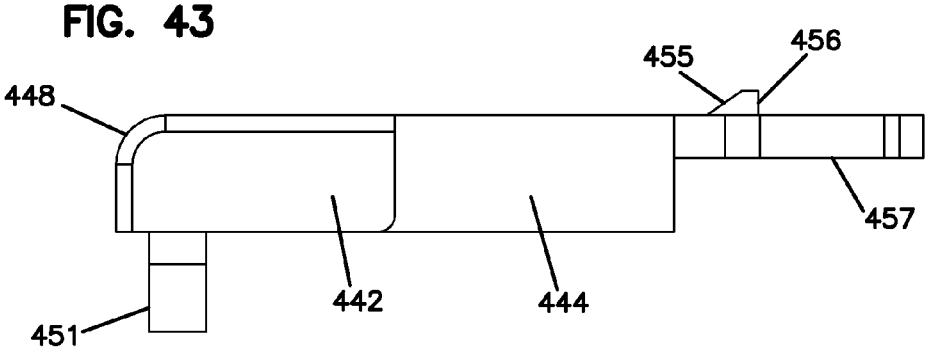
Figure 46:
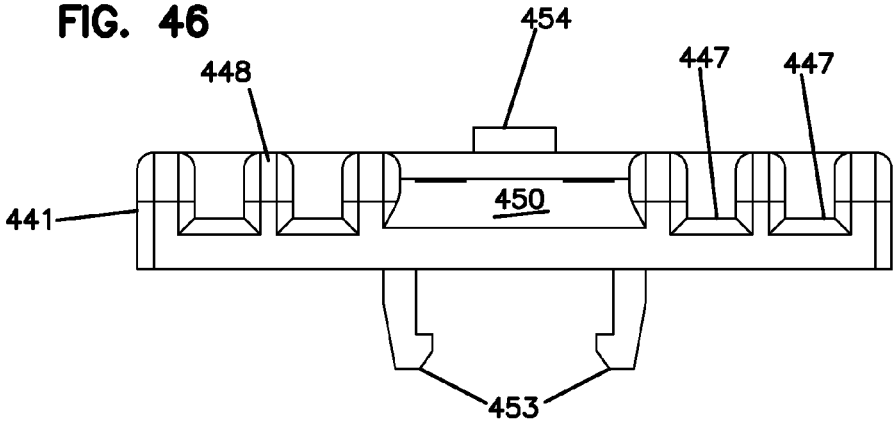
Figure 47:
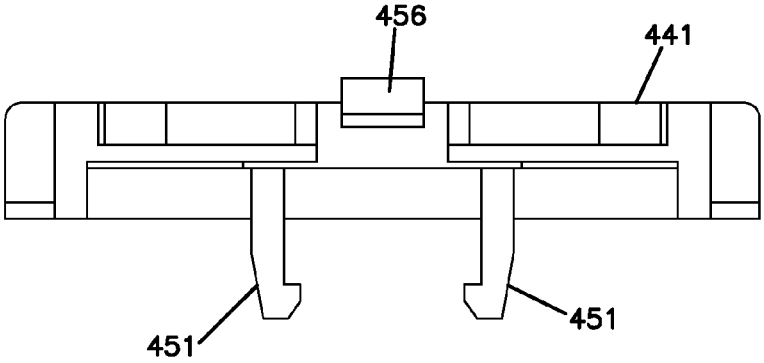

In certain implementations, the storage device 420 is secured in a particular position by latching or locking the shroud 440 to the cover 430. In some implementations, the shroud body 441 includes a locking member 454 extending rearwardly of the body 441 (FIG. 39). In the example shown, the locking member 454 includes a resilient tab that can be flexed or otherwise moved upwardly and downwardly relative to the plug nose body 411. The resilient tab 454 defines a forward ramp surface 455 and a rearward shoulder 456. The cover 430 defines a channel 436 into which the resilient tab 454 can latch when the shroud 440 is positioned to align the tab 454 and channel 436 (e.g., see FIG. 4). To release the shroud 440, a tool (e.g., a customized tool, a pen, a pencil, a screw driver, a piece of wire, or other thin-tipped object may be inserted into the channel 436 to depress the tab 454. By depressing the tab 454, the user frees the shroud 440 from the cover 430, thereby enabling the user to move the shroud 440 and storage component 420 to the extended position.

Figure 50:
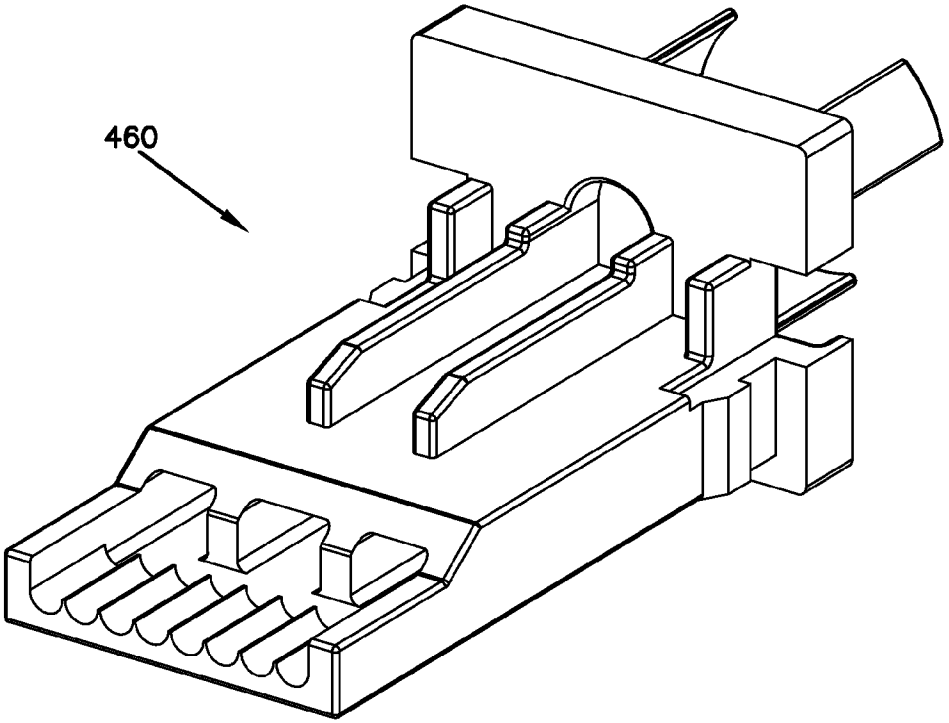
FIGS. 50-52 illustrate various views of the example wire manager shown in FIG. 4 in accordance with aspects of the present disclosure.
Figure 51:
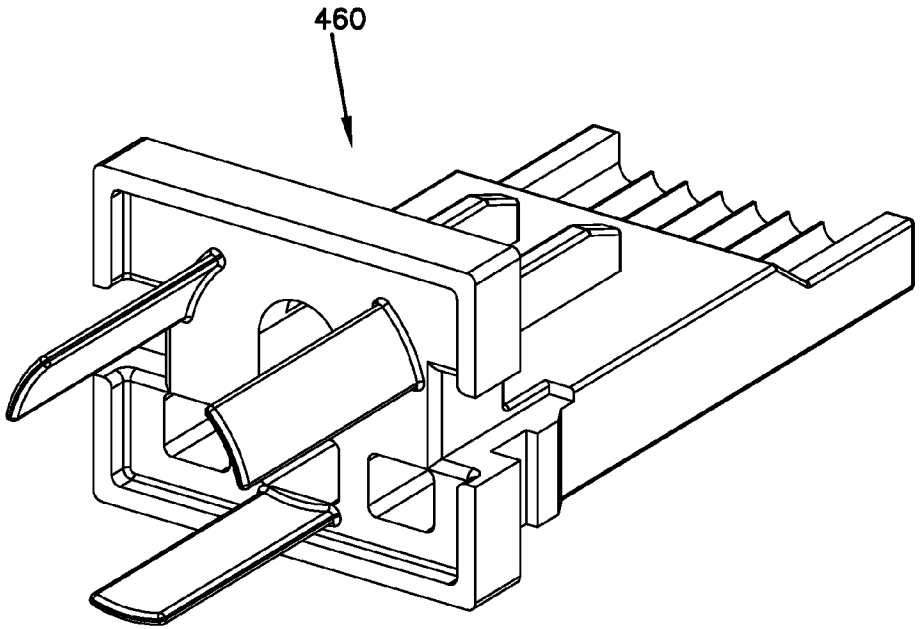
Figure 52:
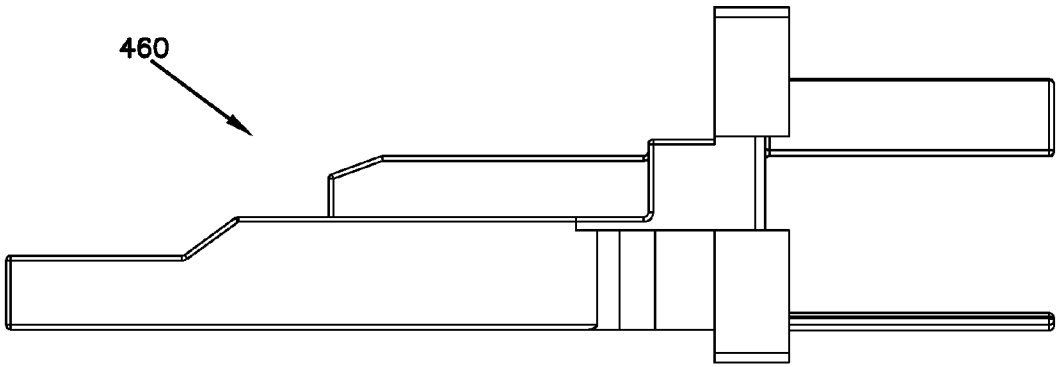
Figure 53:
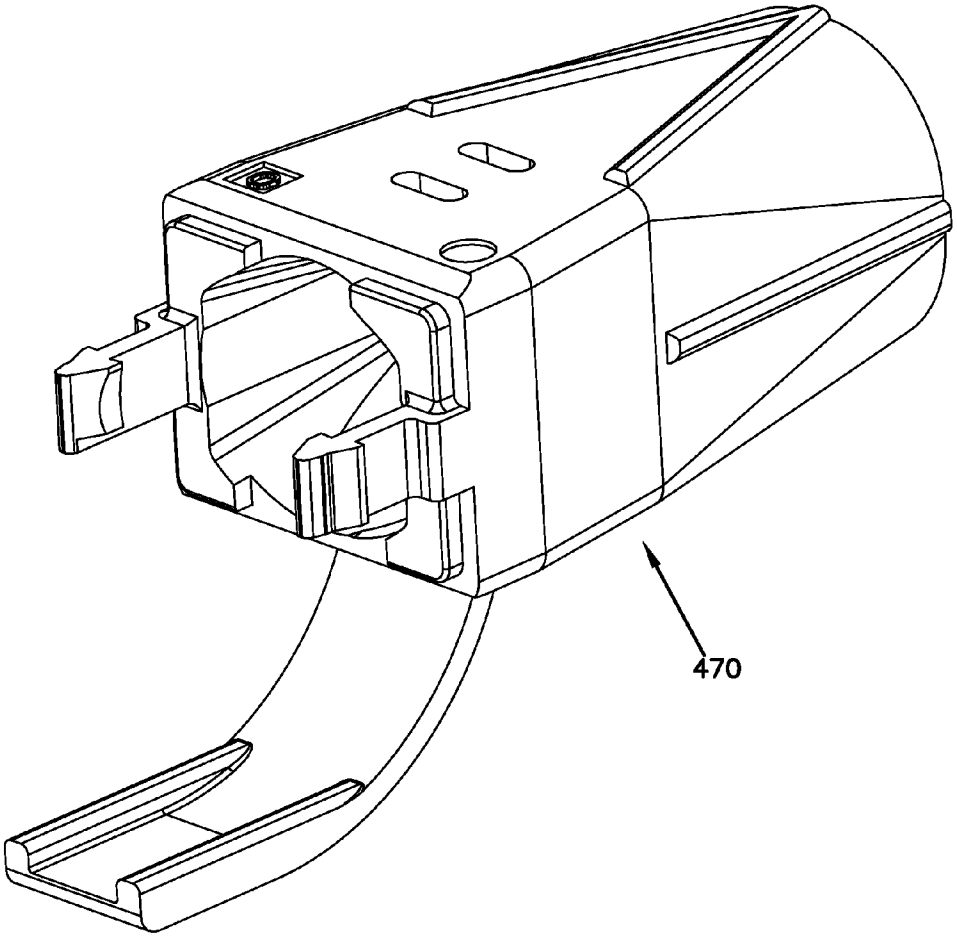
FIGS. 53-54 illustrate front and rear perspective views of the example boot shown in FIG. 4 in accordance with aspects of the present disclosure.
Figure 54:
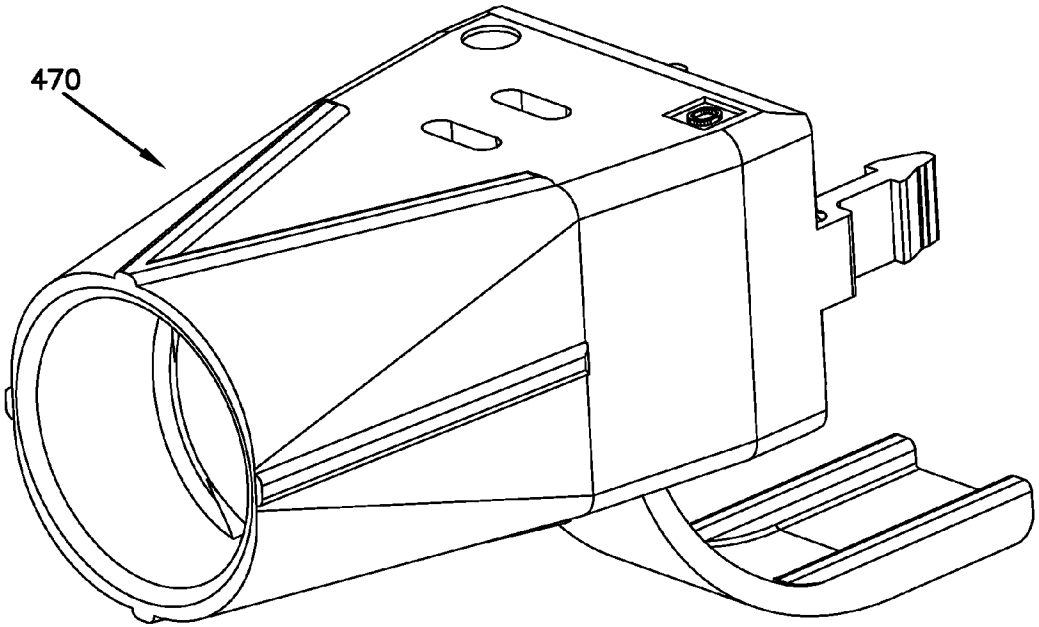

FIGS. 50-52 show one example cable manager 460 suitable for use with the plug 402 shown and described herein. FIGS. 53-54 show one example strain relief boot 470 suitable for use with the plug 402 and cable manager 460 shown and described herein. Further details regarding one example strain relief boot can be found in U.S. Pat. No. 7,413,466, the disclosure of which is hereby incorporated by reference herein.

A number of implementations of the invention defined by the following claims have been described. Nevertheless, it will be understood that various modifications to the described implementations may be made without departing from the spirit and scope of the claimed invention. Accordingly, other implementations are within the scope of the following claims.

The invention claimed is:

1. A connector arrangement comprising:

a plug body having a front, a back, a first side, and a second side, the plug body including main signal contacts positioned at the front of the plug body, the plug body defining a partial enclosure;

a storage component seated on the plug body at least partially within the partial enclosure, the storage component including memory configured to store physical layer information; and secondary contacts positioned within the partial enclosure of the plug body and being coupled to the storage component, the secondary contacts being moveable relative to the plug body between extended and retracted positions.

2. The connector arrangement of claim 1, wherein the plug body includes a plug nose body and a cover that cooperate to define the partial enclosure.

3. The connector arrangement of claim 1, wherein the plug body includes a finger tab extending from the first side of the plug body.

4. The connector arrangement of claim 3, wherein the partial enclosure is formed on the second side of plug body.

5. The connector arrangement of claim 4, wherein the main signal contacts are located on the second side of the plug body.

6. The connector arrangement of claim 1, wherein the main signal contacts and secondary contacts are located on a common one of the first and second sides of the plug body.

7. The connector arrangement of claim 1, wherein the storage component includes a printed circuit board and the secondary contacts are positioned on the printed circuit board.

8. The connector arrangement of claim 7, wherein the storage component includes an EEPROM mounted to the printed circuit board.

9. The connector arrangement of claim 1, further comprising a shroud mounted to the plug body over the storage component and the secondary contacts to close the partial enclosure, the shroud being configured to move with the secondary contacts relative to the plug body, the shroud defining slots through which the secondary contacts are accessible.

10. The connector arrangement of claim 9, wherein the shroud is latchable in at least one of the extended and retracted positions.

11. The connector arrangement of claim 10, wherein the shroud includes a latching tab that snaps into an opening defined in the plug body at the partial enclosure.

12. The connector arrangement of claim 10, wherein the shroud includes a biasing element that biases the shroud and the storage component to the extended position.

13. The connector arrangement of claim 12, wherein the shroud includes a latching tab that releasably locks the shroud and the storage component in the refracted position.

14. The connector arrangement of claim 9, wherein an inner surface of the shroud defines a recess in which the storage component fits.

15. A method of connecting a plug to a socket, the socket including at least a primary contact arrangement, the method comprising:

providing a plug body including main signal contacts that are configured to connect to the primary contact arrangement of the socket, the plug body also including secondary contacts;

determining that the socket does not include a media reading interface that is configured to interface with the secondary contacts of the plug body;

moving the secondary contacts from an extended position to a retracted position relative to the plug body; and inserting the plug body into the socket.

16. The method of claim 15, further comprising latching the secondary contacts into the retracted position.

17. The method of claim 15, wherein moving the secondary contacts comprises pushing the secondary contacts against a spring bias.

18. The method of claim 17, wherein moving the secondary contacts comprises pushing on a shroud coupled to the secondary contacts.

19. A plug and socket system comprising:

a socket including a housing defining a port, the socket also including primary socket contacts and secondary socket contacts arranged within the port; and a plug including a body at which wires of a cable are terminated, the plug also including main signal contacts terminating the wires of a cable, the plug also including a storage component that is slideably connected to the plug body, the storage component being configured to slide along an insertion direction of the plug, the storage component including a memory and secondary contacts that are electrically isolated from the wires and the main signal contacts.

20. The plug and socket system of claim 19, wherein the storage component is configured to slide between an extended, in which the secondary contacts make contact with the secondary socket contacts, and a retracted position, in which the secondary contacts are spaced from the secondary socket contacts.

21. A patch cord comprising:

a cable having twisted pair wires;

a plug module including a housing;

a plurality of main contacts positioned on the housing of the plug module, the main contacts being electrically connected to the twisted pair wires of the cable;

a storage component positioned on the housing of the plug module, the storage component including memory configured to store physical layer information; and a plurality of secondary contacts positioned on the housing of the plug module, the secondary contacts being electrically connected to the storage component, the secondary contacts being configured to slide axially along the housing of the plug module between extended and retracted positions.

* * * * *